US009815648B2

(12) United States Patent
Uchino

(10) Patent No.: US 9,815,648 B2
(45) Date of Patent: Nov. 14, 2017

(54) CONVEYANCE UNIT AND IMAGE RECORDING APPARATUS

(71) Applicant: Brother Kogyo Kabushiki Kaisha, Nagoya-shi, Aichi-ken (JP)

(72) Inventor: Yuta Uchino, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 15/083,657

(22) Filed: Mar. 29, 2016

(65) Prior Publication Data

US 2016/0289023 A1 Oct. 6, 2016

(30) Foreign Application Priority Data

Mar. 31, 2015 (JP) ..... 2015-074536
Jan. 29, 2016 (JP) ..... 2016-016145

(51) Int. Cl.
*B65H 5/02* (2006.01)
*B65H 5/06* (2006.01)
*B65H 1/26* (2006.01)

(52) U.S. Cl.
CPC ..... *B65H 5/062* (2013.01); *B65H 1/266* (2013.01); *B65H 2403/51* (2013.01); *B65H 2404/1431* (2013.01); *B65H 2404/1441* (2013.01); *B65H 2404/152* (2013.01); *B65H 2601/11* (2013.01)

(58) Field of Classification Search
CPC ..... B65H 2404/14; B65H 2404/144; B65H 5/02; B65H 5/06; B65H 2404/1451; B65H 1/027; B65H 2405/31; B65H 2405/32; B65H 2405/35; B65H 1/04; B65H 3/0684; B65H 3/5261; B65H 3/5215; B65H 1/266
USPC ..... 271/272–274, 162, 157
See application file for complete search history.

(56) References Cited

U.S. PATENT DOCUMENTS 6,695,303 B2 * 2/2004 Okada ..... B65H 1/266 271/164
8,132,809 B2 * 3/2012 Shiraishi ..... B65H 1/266 271/125
2015/0028536 A1 * 1/2015 Takai ..... B65H 3/0684 271/117

FOREIGN PATENT DOCUMENTS

JP H07-33268 A 2/1995
JP H07-277552 A 10/1995
JP 2012-091489 A 5/2012

* cited by examiner

*Primary Examiner* — Thomas Morrison
(74) *Attorney, Agent, or Firm* — Banner & Witcoff, Ltd.

(57) ABSTRACT

There is provided a conveyance unit including a conveyance roller; a nip member movable between a contact position and a separation position; a tray movable between an installation position and a pull-out position; and a lever. The lever is configured to have a first state, a second state and a third state. The lever in the first state can make contact with the tray moving between the installation position and the pull-out position. The lever pivots from the first state to the second state when the tray moves from the installation position to the pull-out position, and the lever pivots from the first state to the third state when the tray moves from the pull-out position to the installation position. The conveyance unit further includes an interlocking mechanism.

17 Claims, 17 Drawing Sheets

CONVEYANCE UNIT AND IMAGE RECORDING APPARATUS

CROSS REFERENCE TO RELATED APPLICATION

The present application claims priorities from Japanese Patent Application Nos. 2015-074536 and 2016-016145 filed on Mar. 31, 2015 and Jan. 29, 2016, the disclosures of which are incorporated herein by reference in its entirety.

BACKGROUND

Field of the Invention

The present invention relates to a conveyance unit configured to convey a sheet and an image recording apparatus provided with the conveyance unit.

Description of the Related Art

When a paper jam occurs, for example, in an image recording apparatus, a user performs a process (hereinafter referred to as "jam process") for removing the recording paper jammed in a paper conveyance route or the like. In conventional image recording apparatuses, a nip state, in which rollers of a conveyance roller pair are in contact with each other while nipping the recording paper therebetween under pressure, is automatically released for the jam process.

In the image recording apparatus automatically releasing the nip state, the nip state of the conveyance roller pair is automatically released simply by pulling a feed tray out of an apparatus body, and thus the user can easily remove the jammed recording paper, for example, through an opening for the feed tray provided in the apparatus body. Such a conventional image recording apparatus further includes a mechanism which automatically returns the conveyance roller pair to the nip state, for example, when the user has installed the feed tray in the apparatus body after completion of the jam process.

SUMMARY

As described above, the conventional image recording apparatus includes the interlocking or cooperative mechanism, which automatically releases the nip state of the conveyance roller pair and automatically returns the conveyance roller pair to the nip state in conjunction with the installation and pull-out of the feed tray. This interlocking or cooperative mechanism includes a release member. The release member projects into a space in which the feed tray is installed or pulled out and can pivot by making contact with the tray moved by the user or the like. The state change of the release member in one direction during the process for pulling the feed tray out of the apparatus body is transmitted as the movement which separates one of the rollers of the conveyance roller pair from the other roller. The nip state of the conveyance roller pair is released, accordingly. Meanwhile, the state change of the release member in the other direction during the process for installing or inserting the feed tray into the apparatus body is transmitted as the movement which restores the conveyance roller pair to the nip state.

In the conventional image recording apparatus, for example, in a state that the feed tray is pulled out of the apparatus body and that the nip state of the conveyance roller pair is released, the conveyance roller pair may return to the nip state due to, for example, a user's erroneous operation, with the feed tray being pulled out of the apparatus body. In such a case, the state or posture of the release member changes accompanying with the return of the conveyance roller pair to the nip state, that is, the release member moves to a position corresponding to the nip state of the conveyance roller pair. The position of the release member taken when the conveyance roller pair is in the nip state is different from a position of the release member taken when the nip state of the conveyance roller pair is released. Thus, when the user tries to install or insert the feed tray into the apparatus body, the feed tray may hit the release member after the posture change and the feed tray may fail to reach the installation position.

The present teaching has been made in view of the above circumstances, and an object of the present teaching is to provide a conveyance unit and an image recording apparatus provided with the conveyance unit, the conveyance unit including a conveyance mechanism configured to convey a sheet while nipping the sheet and an interlocking or cooperative mechanism configured to switch a state of the conveyance mechanism between a nip state in which the sheet is nipped and a nip released state in which the nip state is released in conjunction with installation and removal of a tray supporting the sheet relative to the image recording apparatus. The interlocking mechanism enables the tray to be installed in and pulled out of the image recording apparatus without obstruction.

According to an aspect of the present teaching, there is provided a conveyance unit configured to convey a sheet, including:

a conveyance roller;

a nip member configured to nip the sheet between the nip member and the conveyance roller and to move between a contact position in which the nip member is in contact with the conveyance roller and a separation position in which the nip member is separate from the conveyance roller;

a tray configured to support the sheet, to be installed in and be pulled out of the conveyance unit, and to move between an installation position in which the tray is installed in the conveyance unit and a pull-out position in which the tray is pulled out of the conveyance unit;

a lever configured to pivot around a pivoting shaft extending in an intersecting direction, which intersects an installation direction in which the tray is installed into the conveyance unit and a pull-out direction in which the tray is pulled out of the conveyance unit, wherein the lever is configured to have a first state, a second state, and a third state, the second state being a state in which the lever in the first state has pivoted around the pivoting shaft in a first pivoting direction, the third state being a state in which the lever in the first state has pivoted around the pivoting shaft in a second pivoting direction which is an opposite direction of the first pivoting direction, the lever in the first state is configured to make contact with the tray moving between the installation position and the pull-out position, the lever pivots from the first state to the second state by making contact with the tray moving from the installation position to the pull-out position, and the lever pivots from the first state to the third state by making contact with the tray moving from the pull-out position to the installation position; and an interlocking mechanism configured to move the nip member to the separation position due to the pivoting of the lever from the first state to the second state and to move the nip member to the contact position due to the pivoting of the lever from the first state to the third state.

In the above configuration, when the tray is in the installation position, the nip member is in the contact position where the nip member is in contact with the conveyance roller, namely, the conveyance mechanism including the conveyance roller and the nip member is in the nip state in which the sheet can be nipped thereby, and the lever is biased to have the first state as a specified state. When the tray moves from the installation position to the pull-out position, the tray makes contact with the lever in the first state and the lever pivots from the first state to the second state in the first pivoting direction. The pivoting of the lever from the first state to the second state causes the interlocking mechanism to move the nip member to the separation position. This releases the nip state of the conveyance mechanism, that is, the conveyance mechanism becomes the nip released state. Further, the lever returns to the first state as the specified state. Accordingly, the jam process can be easily performed for example, in the ink-jet recording apparatus.

Meanwhile, when the tray moves from the pull-out position to installation position, the tray makes contact with the lever in the first state and the lever pivots from the first state to the third state in the second pivoting direction. The pivoting of the lever from the first state to the third state causes the interlocking mechanism to move the nip member to the contact position. The conveyance mechanism becomes the nip state, accordingly. Further, the lever returns to the first state as the specified state. Then, the ink-jet recording apparatus has recovered from the paper jam and can perform recording of an image on a recording sheet. In the above configuration, the lever in the first state can make contact with the tray both of when the conveyance mechanism is in the nip state and when the conveyance mechanism is in the nip released state, thereby changing the state of the conveyance mechanism between the nip state and the nip released state. Therefore, even when the conveyance mechanism has returned to the nip state due to, for example, an erroneous operation by a user, with the tray being pulled out of the image recording apparatus, it is possible to easily prevent a situation in which the tray hits the lever and has difficulty in being installed in the image recording apparatus.

BRIEF DESCRIPTION OF THE DRAWINGS

FIGS. 6A and 6B are cross sectional views taken along the arrow V-V of FIG. 3 which respectively depict positional relations between a lever 54 and a feed tray 20, wherein FIG. 6A depicts a state in which the feed tray 20 is positioned in an installation position P1 and FIG. 6B depicts a state in which the feed tray 20 is in the course of being pulled out of the printer unit 11.

FIGS. 7A and 7B are cross sectional views taken along the arrow V-V of FIG. 3 which respectively depict positional relations between the lever 54 and the feed tray 20, wherein FIG. 7A depicts a state in which the feed tray 20 is positioned in a pull-out position P2 and FIG. 7B depicts a state in which the feed tray 20 is in the course of being installed in the multifunction peripheral 10.

FIGS. 11A and 11B are cross sectional views taken along the arrow XI-XI of FIG. 10, wherein FIG. 11A depicts a state in which the moving member 153 is in a first position and FIG. 11B depicts a state in which the moving member 153 is in a second position.

DESCRIPTION OF THE EMBODIMENTS

In the following, an explanation will be made about an embodiment of the present teaching with reference to drawings as appropriate. It is needless to say that the embodiment to be explained below is merely an example of the present teaching, and it is possible to appropriately change the embodiment of the present teaching without departing from the gist and scope of the present teaching. In the following explanation, an upper direction 7A and a lower direction 7B are defined based on the state in which a multifunction peripheral 10 is placed to be usable (the state depicted in FIG. 1). A front direction 8A and a rear direction 8B are defined as a surface of the multifunction peripheral 10 on which an opening 13 is provided is positioned on the near side (the front side). A left direction 9A and a right direction 9B are defined as the multifunction peripheral 10 is viewed from the near side (the front side).

<Entire Structure of Multifunction Peripheral 10>

Figure 1:
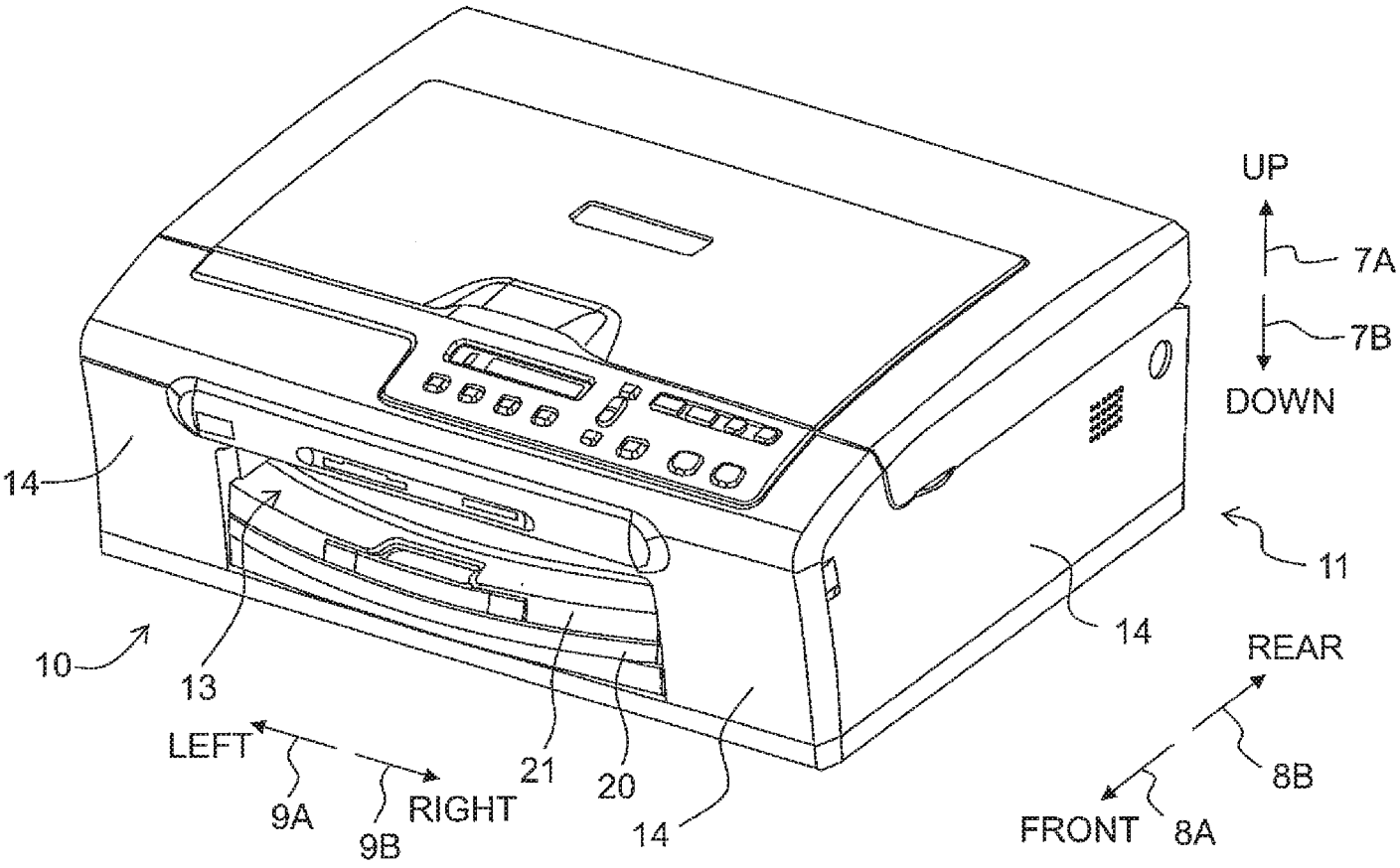
FIG. 1 is a perspective view of a multifunction peripheral 10 including a printer unit 11 as an image recording apparatus according to an embodiment of the present teaching.

As depicted in FIG. 1, the multifunction peripheral 10 is formed to have a substantially rectangular parallelepiped shape of a thin type. A printer unit 11 (an exemplary image recording apparatus) is provided at a lower part of the multifunction peripheral 10. The multifunction peripheral 10 has various functions such as a facsimile function and a print function. As the print function, the multifunction peripheral 10 has a function of recording an image on one surface of a recording sheet (paper) 12 (see FIG. 2) by an ink-jet recording system. Note that the multifunction peripheral 10 may have a function of recording an image on both surfaces of the recording sheet 12. The printer unit 11 includes a conveyance unit which conveys the recording sheet 12. The conveyance unit includes a conveyance roller pair 59 and an interlocking or cooperative mechanism (an exemplary interlocking or cooperative mechanism) which switches a state of the conveyance roller pair 59 between a nip state and a release state (nip released state) in mechanical conjunction with the insertion and removal of the feed tray 20.

<Feed Tray 20>

As depicted in FIG. 1, the opening 13 is formed in the front surface of the printer unit 11. Moving the feed tray 20 in the front direction 8A and the rear direction 8B enables the insertion and removal of the feed tray 20 with respect to the printer unit 11 via the opening 13. In this context, the front direction 8A is an exemplary pull-out direction (removal direction) and the rear direction 8B is an exemplary installation direction (insertion direction).

Figure 2:
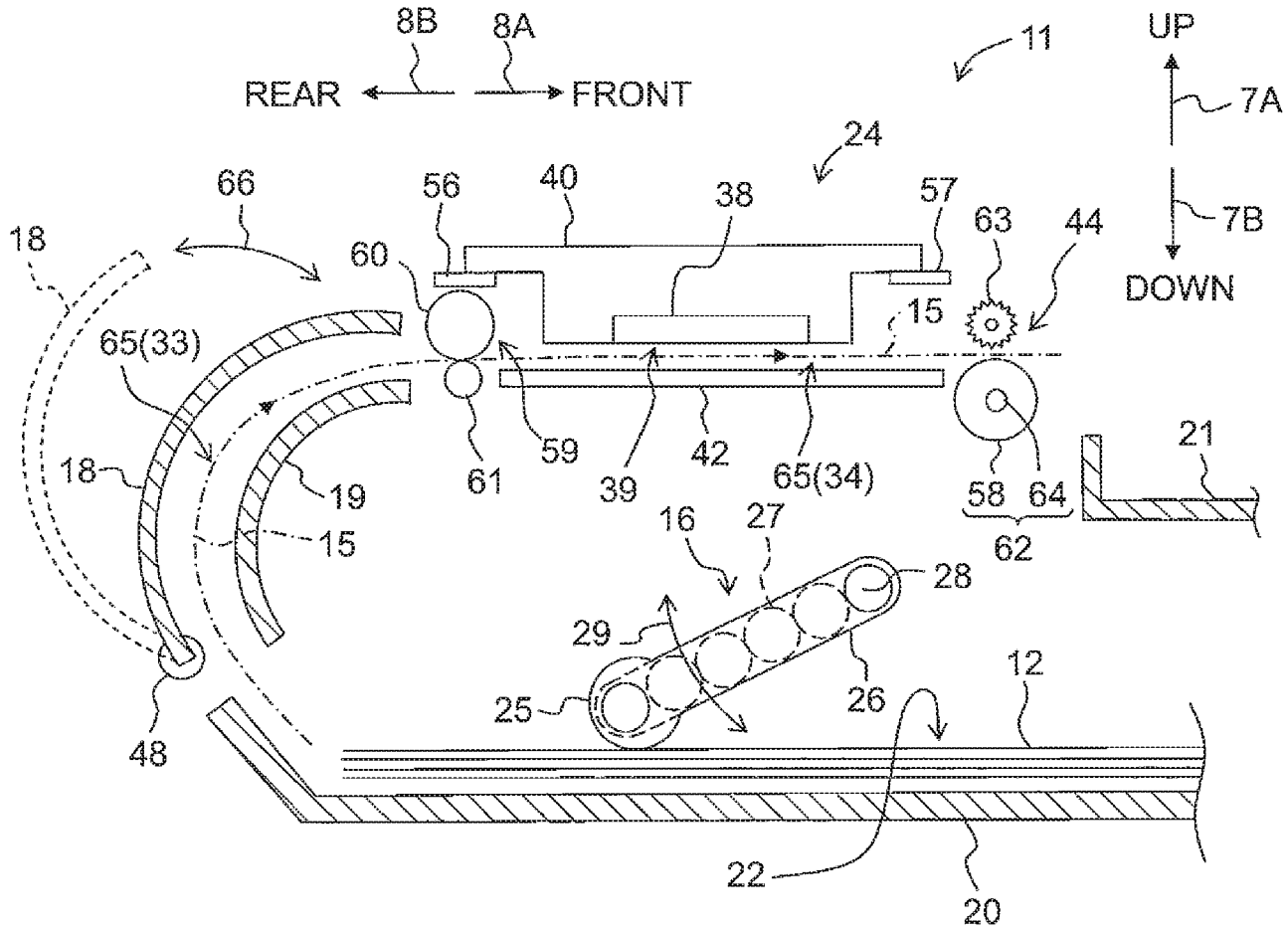
FIG. 2 is a vertical cross-sectional view schematically depicting an internal structure of the printer unit 11.
Figure 6A:
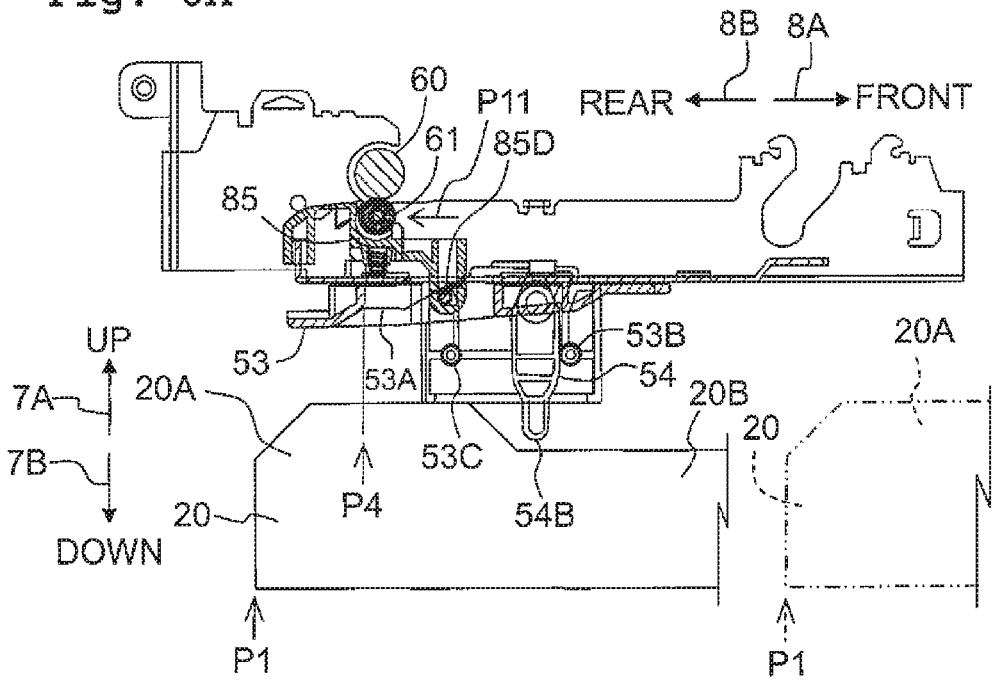
Figure 6B:
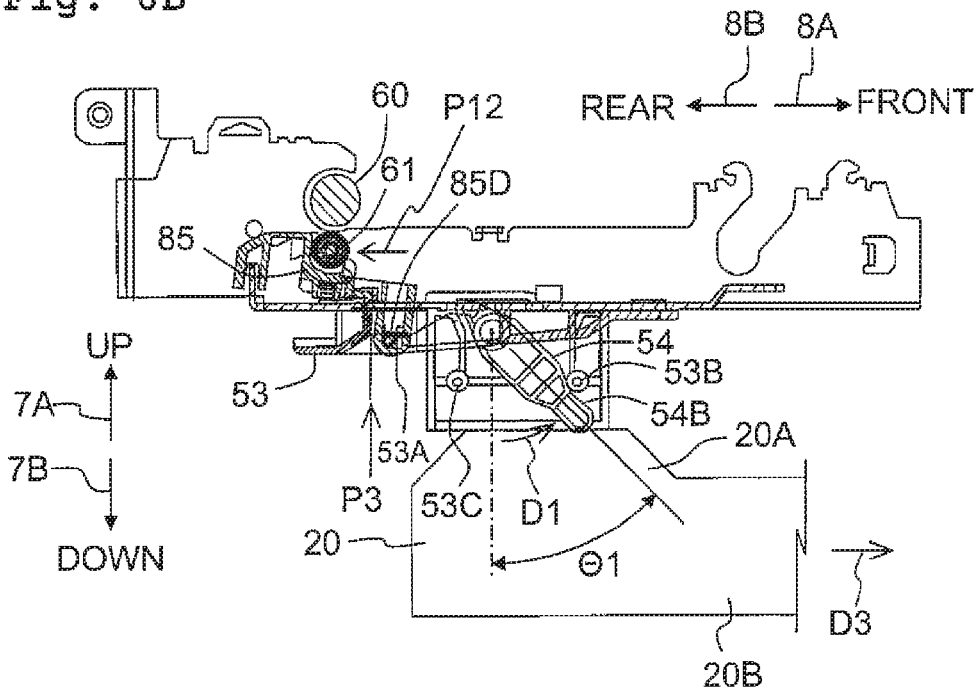

As depicted in FIG. 2, a plurality of recording sheets 12 are placed in a stacked state on a bottom plate 22 of the feed tray 20. The feed tray 20 is a box-shaped member which is open at the upper side thereof. As depicted in FIGS. 6A and 6B, approximately rectangular side plates 20B extending in the upper direction 7A are provided to stand at the left and right ends of the approximately rectangular bottom plate 22. A projecting part 20A (an exemplary lever contact part), which projects in the upper direction 7A to make contact with a lever 54, is formed at the rear end of each side plate 20B.

The feed tray 20 has side guides (not depicted in the drawings) which are movable in the left direction 9A and right direction 9B and are supported by the bottom plate 22 of the feed tray 20. The side surfaces of the side guides make contact with the left and right ends of the recording sheets 12 supported by the bottom plate 22. When one of the side guides moves in the left direction 9A, the other of the side guides moves in the right direction 9B in conjunction with the movement of one of the side guides in the left direction 9A. When one of the side guides moves in the right direction 9B, the other of the side guides moves in the left direction 9A in conjunction with the movement of one of the side guides in the right direction 9B. Namely, in this embodiment, each recording sheet 12 is positioned with the center of the feed tray 20 in the left direction 9A and right direction 9B as the reference.

<Discharge Tray 21>

A discharge tray 21 is supported by the feed tray 20 on the front upper side of the feed tray 20. The discharge tray 21 moves in the front direction 8A and rear direction 8B integrally with the feed tray 20. The recording sheet 12, for which an image is recorded by a recording unit 24, is discharged onto the discharge tray 21.

<Feed Unit 16>

As depicted in FIG. 2, a feed unit 16 is disposed on the upper side of the bottom plate 22 of feed tray 20 installed in the printer unit 11 and on the lower side of the recording unit 24. The feed unit 16 includes a feed roller 25, a feed arm 26, and a drive transmitting mechanism 27. The feed roller 25 is rotatably supported by the front end of the feed arm 26. The feed arm 26 pivots in directions indicated by an arrow 29, with a supporting shaft 28 disposed at the base end of the feed arm 26 as the pivoting center. Accordingly, the feed roller 25 makes contact with and separates away from the feed tray 20 or the recording sheet 12 supported by the feed tray 20.

The feed roller 25 rotates by receiving the driving force of a conveyance motor (not depicted in the drawings) transmitted by the drive transmitting mechanism 27 including gears. An uppermost recording sheet 12, of the recording sheets 12 supported by the bottom plate 22 of the feed tray 20, which is in contact with the feed roller 25 is fed to a conveyance route 65 due to rotation of the feed roller 25. The feed roller 25 may be rotated by the driving force transmitted from a motor provided separately from the conveyance motor. The drive transmitting mechanism 27 is not limited to the structure including the gears. The drive transmitting mechanism 27 may be, for example, a belt stretched between the supporting shaft 28 and the shaft of the feed roller 25.

<Conveyance Route 65>

As depicted in FIG. 2, the conveyance route 65 extends from the rear end of the feed tray 20. The conveyance route 65 includes a curved portion 33 and a linear portion 34. The curved portion 33 extends to have a curve, of which outer side is in the rear direction 8B and of which inner side is in the front direction 8A. The linear portion 34 extends in the front direction 8A and rear direction 8B.

The curved portion 33 is defined by a first guide member 18 and a second guide member 19 which are arranged to face with each other with a predetermined gap intervened therebetween. The first guide member 18 defines the outer side of the curve of the curved portion 33. The second guide member 19 defines the inner side of the curve of the curved portion 33. At a position where the recording unit 24 is arranged, the linear portion 34 is defined by the recording unit 24 and the platen 42 which are arranged to face with each other with a predetermined gap intervened therebetween. The first guide member 18 and second guide member 19 extend in the left direction 9A and right direction 9B orthogonal to the sheet surface of FIG. 2.

The recording sheet 12 supported by the feed tray 20 is conveyed by the feed roller 25 while making a U-turn from a lower part toward an upper part of the curved portion 33, and then reaches the conveyance roller pair 59. The recording sheet 12 nipped or pinched by the conveyance roller pair 59 is conveyed through the linear portion 34 in the front direction 8A in a state that a surface on which an image is to be recorded (image recording surface) faces the recording unit 24. When the recording sheet 12 reaches a position immediately below the recording unit 24, an image is recorded on the image recording surface by the recording unit 24. The recording sheet 12, for which the image has been recorded, is conveyed through the linear portion 34 in the front direction 8A and is discharged on the discharge tray 21. As described above, the recording sheet 12 is conveyed in a conveyance direction 15 indicated by a dashed-dotted arrow in FIG. 2.

<First Guide Member 18>

The first guide member 18 is configured to be pivotable in directions of an arrow 66 with a shaft 48 formed on a lower part of the first guide member 18 as the pivoting center. When the first guide member 18 is in a first state indicated by a solid line in FIG. 2, the first guide member 18 defines the outer side of the curved portion 33. When the first guide member 18 is in a second state indicated by a broken line in FIG. 2, the curved portion 33 is exposed to the outside. By changing a state of the first guide member 18 from the first state to the second state, a user is capable of removing the recording sheet 12 jammed in the curved portion 33.

The state of the first guide member 18 may be changed in any other way than the pivoting. For example, the first guide member 18 may be detachable from the printer unit 11. In this case, the state of the first guide member 18 changes between a first state, in which the first guide member 18 is installed in the printer unit 11 to define the outer side of the curved portion 33, and a second state, in which the first guide member 18 is removed from the printer unit 11 so that the curved portion 33 is exposed to the outside.

<Recording Unit 24>

As depicted in FIG. 2, the recording unit 24 is disposed on the upper side of the linear portion 34. The recording unit 24 includes a carriage 40 and a recording head 38. The platen 42 is provided on the lower side of the recording unit 24 to face the recording unit 24. The recording sheet 12 conveyed by the conveyance roller pair 59 through the linear portion 34 is supported by an upper surface of the platen 42.

The carriage 40 is supported to be reciprocatable in the left direction 9A and right direction 9B by two guide rails 56*a*, 56*b* which are provided with a distance intervening therebetween in the front direction 8A and rear direction 8B. The recording head 38 is installed in the carriage 40. An ink is supplied from an ink cartridge (not depicted in the drawing) to the recording head 38. Nozzles 39 are formed in a lower surface of the recording head 38. The recording head 38 jets ink droplets from nozzles 39 toward the platen 42 while the carriage 40 is moving in the left direction 9A and right direction 9B. Accordingly, an image is recorded on the recording sheet 12 supported by the platen 42.

<Conveyance Roller Pair 59>

As depicted in FIG. 2, the conveyance roller pair 59 is disposed in the linear portion 34 of the conveyance route 65 at the upstream side of the recording head 38 in the conveyance direction 15. A discharge roller pair 44 is disposed in the linear portion 34 at the downstream side of the recording head 38 in the conveyance direction 15.

<Conveyance Roller 60>

Figure 3:
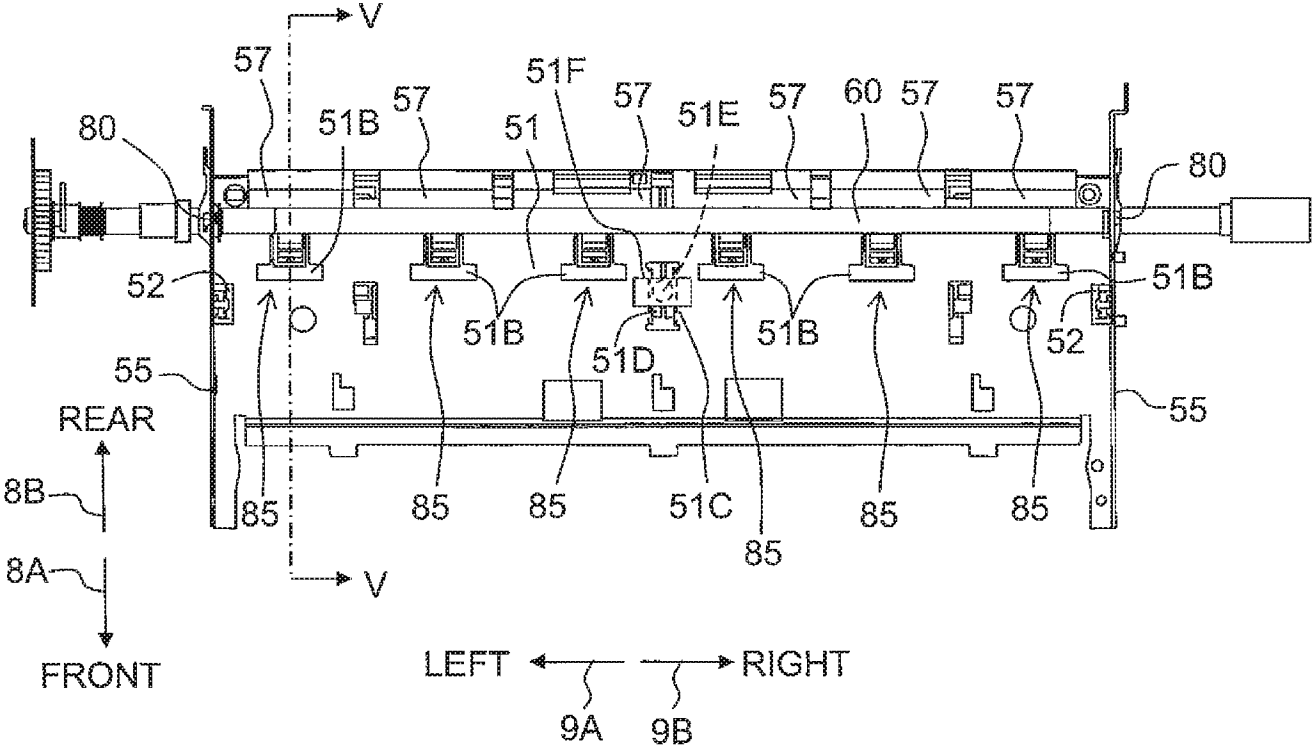
FIG. 3 is a top view of a first frame 51 supporting a conveyance roller 60 as viewed from an upper direction 7A.

The conveyance roller pair 59 includes a conveyance roller 60 (an exemplary conveyance roller) which is disposed on the upper side of the linear portion 34 and a pinch roller 61 (an exemplary nip member) which is disposed on the lower side of the linear portion 34 to face the conveyance roller 60. As depicted in FIG. 3, the conveyance roller 60 is a cylindrical member which extends in a casing 14 along the left direction 9A and right direction 9B. The conveyance roller 60 is supported by side frames 55 and is positioned on the upper side of a first frame 51.

<Pinch Roller 61>

Figure 4:
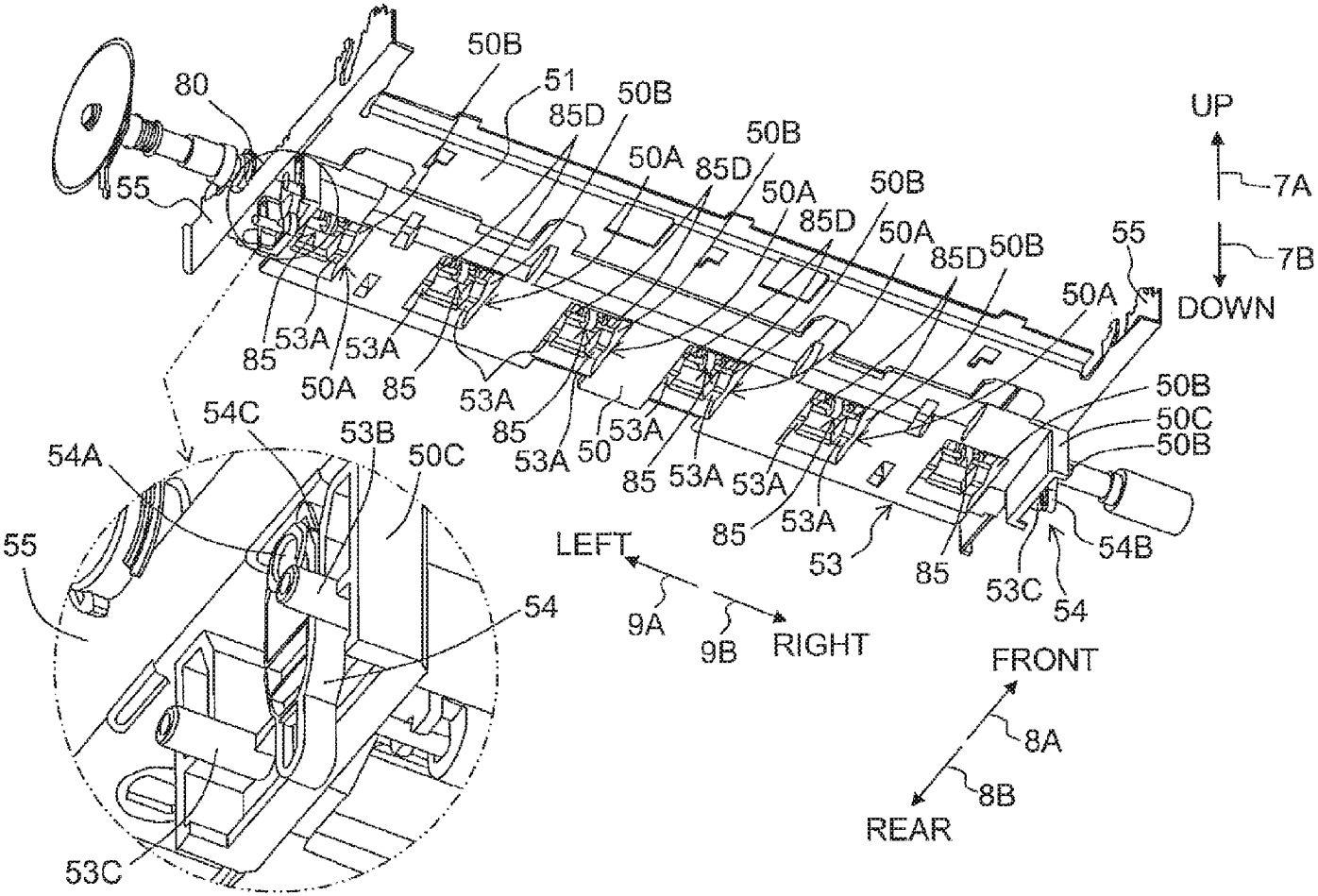
FIG. 4 is a perspective view of the first frame 51 supporting a moving member 53 in a first position as viewed from a lower direction 7B.
Figure 5:
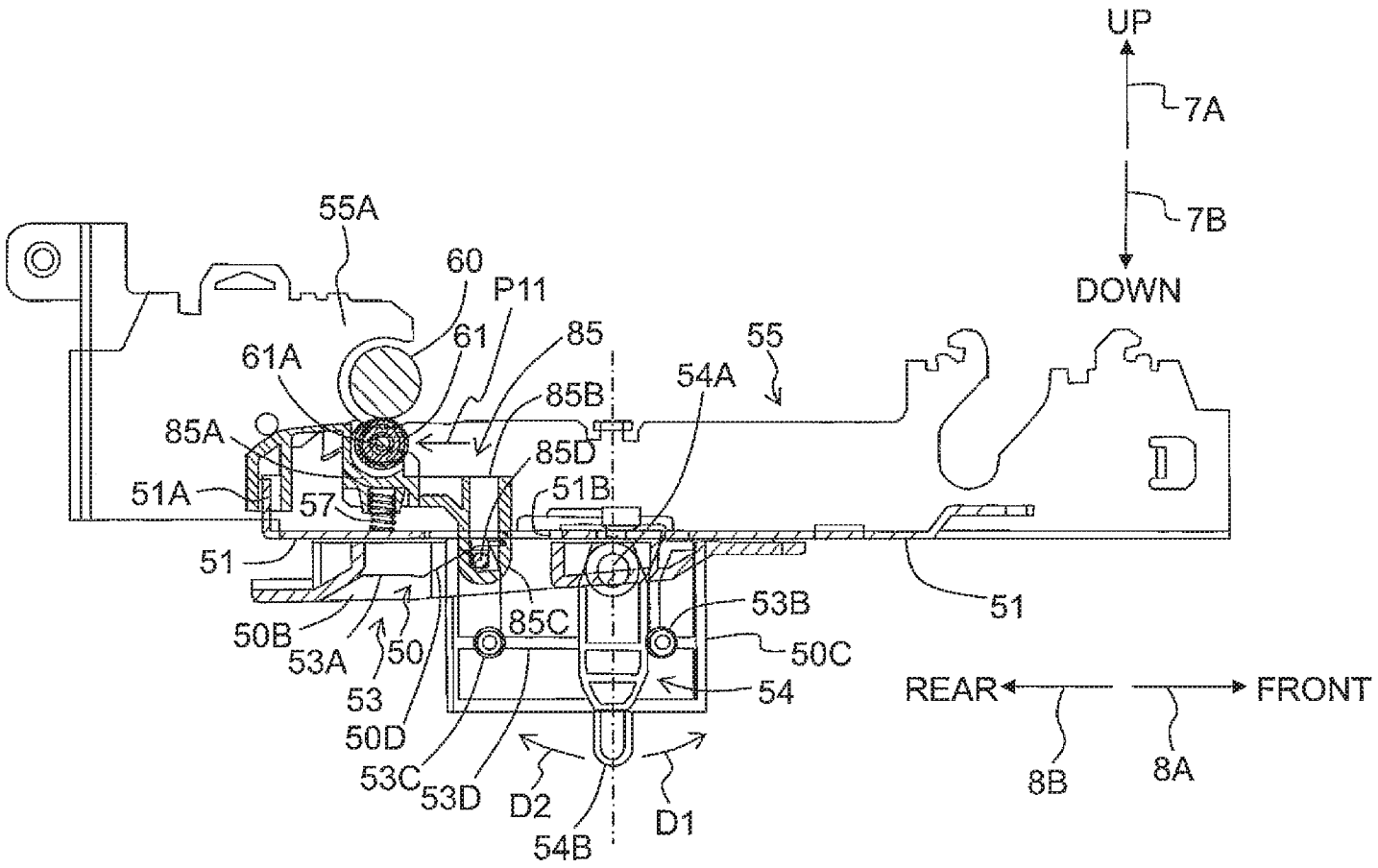
FIG. 5 is a cross sectional view taken along the arrow V-V of FIG. 3.

Pinch rollers 61 are provided in the casing 14 at intervals in the left direction 9A and right direction 9B. As depicted in FIG. 5, the pinch roller 61 has a rotating shaft 61A rotatably supported by a roller holder 85. As depicted in FIG. 4, roller holders 85, which correspond to the pinch rollers 61 respectively, are provided at intervals in the left direction 9A and right direction 9B. Each of the roller holders 85 is supported by the first frame 51 on the upper side of the first frame 51 while being biased, toward the conveyance roller 60 in the substantially upper direction 7A, by a plate-shaped biasing member 57 (an exemplary second biasing member) supported by the first frame 51.

<Discharge Roller Pair 44>

As depicted in FIG. 2, the discharge roller pair 44 includes a discharge roller 62 which is arranged on the lower side of the linear portion 34 and a spur 63 which is arranged on the upper side of the linear portion 34 to face the discharge roller 62. Spurs 63 are provided at intervals in the left direction 9A and right direction 9B. The discharge roller 62 has a shaft 64 extending in the left direction 9A and right direction 9B and a roller part 58 attached to the shaft 64. Similar to the spurs 63, roller parts 58 are provided at intervals in the left direction 9A and right direction 9B to face the spurs 63 respectively. Each of the spurs 63 is pressed against one of the roller parts 58 by an unillustrated elastic member.

The conveyance roller 60 and the discharge roller 62 are rotated by the driving force transmitted from the conveyance motor. Rotating the conveyance roller 60 in a state that the conveyance roller pair 59 nips or pinches the recording sheet 12 (nip state) allows the conveyance roller pair 59 to convey the recording sheet 12 in the conveyance direction 15. Rotating the discharge roller 62 in a state that the discharge roller pair 44 nips or pinches the recording sheet 12 allows the discharge roller pair 44 to convey the recording sheet 12 in the conveyance direction 15.

<Biasing Member 57>

As depicted in FIG. 5, the biasing member 57 may be, for example, a coil spring. The biasing member 57 is disposed on the lower side of a bearing 85A of the roller holder 85 such that an axial direction of the biasing member 57 is parallel to the upper direction 7A and lower direction 7B. An end of the biasing member 57 is in contact with the bearing 85A and the other end is in contact with the first frame 51. In this configuration, the biasing member 57 biases the roller holder 85 in the upper direction 7A so that the pinch roller 61 makes contact with the conveyance roller 60 positioned on the upper side of the pinch roller 61. FIG. 5 depicts a state in which the pinch roller 61 is in a contact position P11 where the pinch roller 61 is in contact with the conveyance roller 60.

<Roller Holder 85>

As depicted in FIG. 5, the roller holder 85 includes the bearing 85A, which rotatably supports the rotating shaft 61A of the pinch roller 61, and a frontward extending part 85B, which extends from the bearing 85A in the front direction 8A. The frontward extending part 85B has a downward extending part 85C which extends from the front end of the frontward extending part 85B in the lower direction 7B. The downward extending part 85C includes, at its lower end, a contact shaft 85D extending in the left direction 9A and right direction 9B. The contact shaft 85D can make contact with a contact surface 53A of a moving member 53. The moving member 53 is movable between a second position P3 (see FIG. 6B) and a first position P4 (see FIG. 6A) in the front direction 8A and rear direction 8B. In the second position P3, the contact surface 53A is in contact with the contact shaft 85D. In the first position P4, the contact surface 53A has no contact with the contact shaft 85D. In this context, the front direction 8A is an exemplary pull-out direction (removal direction) and the rear direction 8B is an exemplary installation direction (insertion direction). When the moving member 53 is in the second position P3, the contact surface 53A of the moving member 53 is in contact with the contact shaft 85D of the roller holder 85 so that the roller holder 85 resists the biasing force of the biasing member 57. Accordingly, the moving member 53 in the second position P3 keeps the pinch roller 61 in a separation position P12 (see FIG. 6B).

The moving member 53 is movably supported by the first frame 51 between the second position P3 and the first position P4. The first frame 51 is provided with a slit 51D, which extends in the front direction 8A and rear direction 8B, at the center of the first frame 51 in the left direction 9A and right direction 9B. The moving member 53 includes, on its upper surface, a boss 51E insertable into the slit 51D. An extending part 51F, which extends in the left direction 9A and right direction 9B at the upper end of the boss 51E, engages with the upper surface of the first frame 51 in a state that the boss 51E protrudes the first frame 51 in the upper direction 7A through the slit 51D. Accordingly, the moving member 53 can be movably supported by the first frame 51 in the front direction 8A and rear direction 8B.

<First Frame 51>

As depicted in FIG. 5, the first frame 51 is a plate-shaped member which is disposed in the casing 14 on the upper side of the feed tray 20 installed in the printer unit 11 to extend in the first direction 8A, rear direction 8B, left direction 9A, and right direction 9B. The first frame 51 has an opening 51B through which the downward extending part 85C of the roller holder 85 protrudes downward. As depicted in FIG. 3, openings 51B are provided along the left direction 9A and right direction 9B while corresponding to the pinch rollers 61. Each contact shaft 85D provided at the lower end of the downward extending part 85C is positioned on the lower side of the first frame 51.

<Side Frame 55>

As depicted in FIG. 3, side frames 55 are provided at the left and right ends of the first frame 51. The side frames 55 are disposed on the left and right sides of the linear portion 34 of the conveyance route 65. Each of the side frames 55 is a plate-shaped member perpendicular to the first frame 51. The lower ends of the side frames 55 are coupled or connected to the left and right ends of the first frame 51 respectively. Or, the first frame 51 and the side frames 55 may be formed as an integrated member.

As depicted in FIG. 5, each of the side frames 55 includes, at its rear end, a wide part 55A which is wide in the upper direction 7A and lower direction 7B. The wide part 55A extends further upward than its adjacent part, and a bearing 80 (see FIG. 4), which rotatably supports the conveyance roller 60, is attached to the front end of the wide part 55A. Each of the side frames 55 rotatably supports the conveyance roller 60 via the bearing 80 on the left and right sides of the linear portion 34 of the conveyance route 65.

<Second Frame 52>

Figure 8:
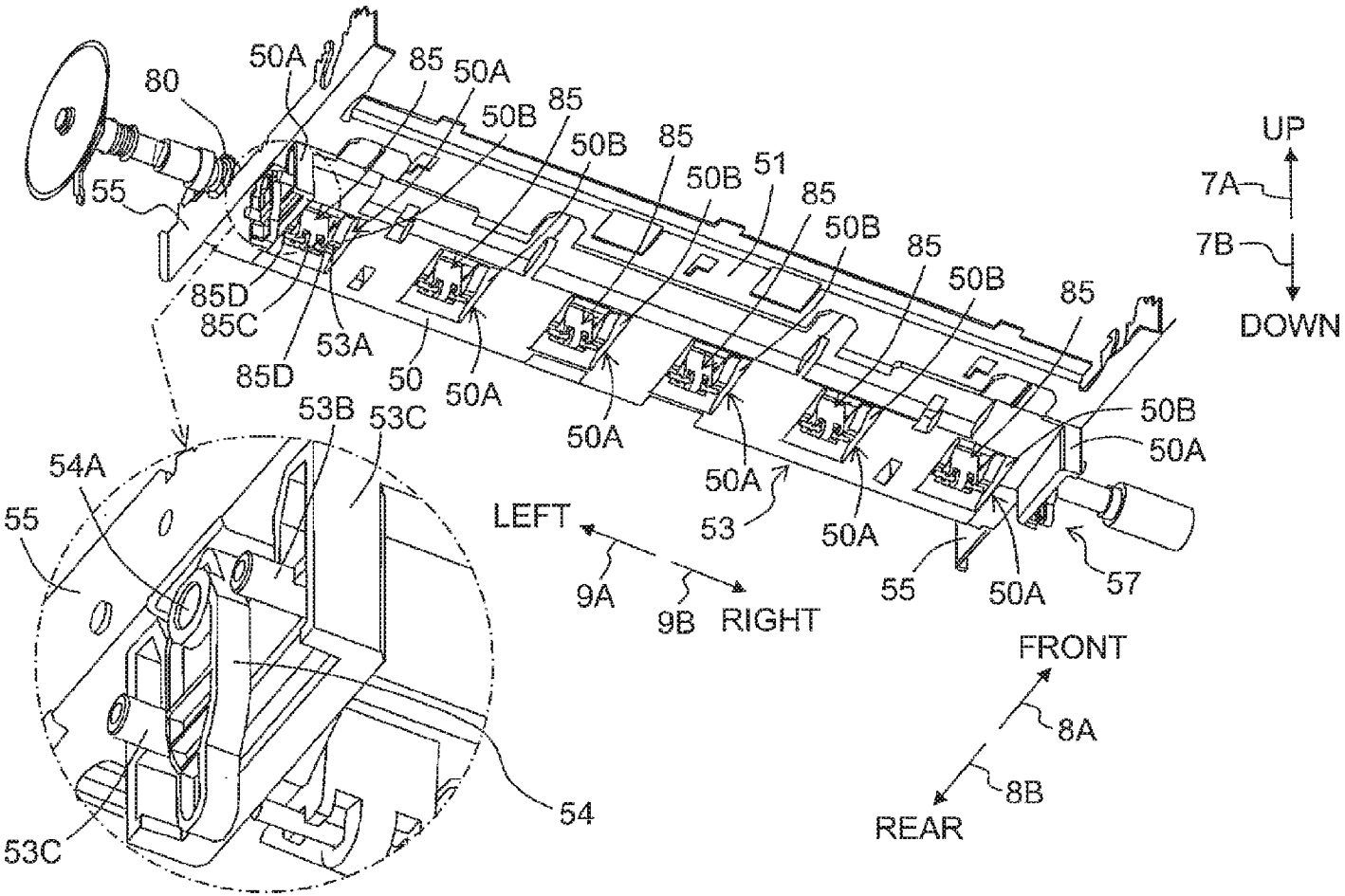
FIG. 8 is a perspective view of the first frame 51 supporting the moving member 53 in a second position as viewed from the lower direction 7B.

As depicted in FIG. 3, second frames 52 are attached to left and right ends of the first frame 51. The second frames 52 are adjacent to the side frames 55, respectively. A pivoting shaft 54A of the lever 54 depicted in FIGS. 4, 5, and 8 is supported by the second frames 52.

<Lever 54>

As depicted in FIG. 5, the lever 54 is provided to pivot around the pivoting shaft 54A, which extends in a direction (the left direction 9A and right direction 9B in FIG. 5) orthogonal to an installation (insertion) direction D4 (see FIG. 7B) and a pull-out direction D3 (see FIG. 6B). The installation direction D4 is a direction in which the feed tray 20 is installed or inserted into the printer unit 11. The pull-out direction D3 is a direction in which the feed tray 20 is pulled out of or removed from the printer unit 11. The lever 54 is biased by a biasing member 54C (an exemplary first biasing member), which is a torsion spring attached to the pivoting shaft MA, to become a first state (a state depicted in FIG. 5) in which a front end 54B as a pivoting front end is positioned on the lower side of the pivoting shaft 54A. As depicted in FIG. 6A, the lever 54 in the first state has no contact with the feed tray 20 in the installation position P1 (in an installation state). Thus, a specified state of the lever 54 is the first state.

<Movement of Feed Tray 20>

As depicted in FIG. 6A, the feed tray 20 installed in the printer unit 11 (in the installation state) is in the installation position P1. In the installation state depicted in FIG. 6A, the lever 54 has no contact with the feed tray 20 (including side plates 20B) and the projecting part 20A. When the feed tray 20 in the installation state depicted in FIG. 6A is pulled out of the printer unit 11, the feed tray 20 is moved in the front direction 8A. In this situation, the projecting part 20A of the feed tray 20 makes contact with the front end 54B of the lever 54 in the first state. As a result, as depicted in FIG. 6B, the lever 54 in the first state pivots around the pivoting shaft 54A in a first pivoting direction D1 by an angle θ1 in the course of the removal of the feed tray 20 from the printer unit 11, which makes the lever 54 the second state. The front end 54B of the lever 54 in the second state is positioned on the upper front side of the front end 54B of the lever 54 in the first state. Note that the angle θ1 is greater than 0° and smaller than 180°.

Figure 7A:
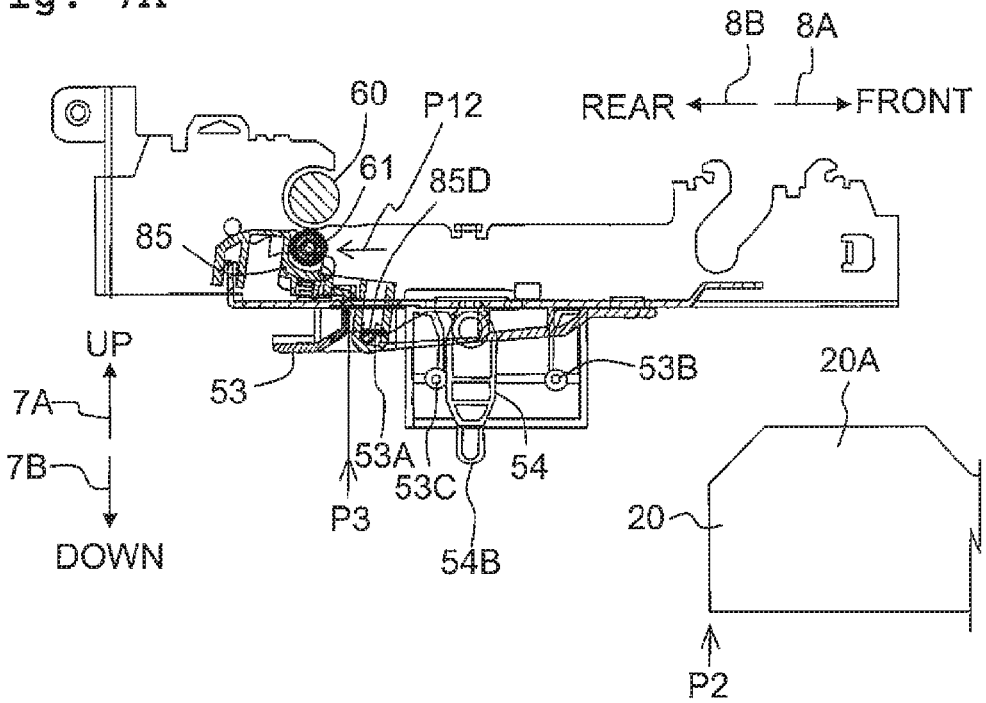

When the feed tray 20 in the state depicted in FIG. 6B is pulled out further, the feed tray 20 moves in the front direction 8A identical to the pull-out direction D3, and reaches the pull-out position P2 depicted in FIG. 7A. In this situation, the lever 54 has the first state due to the biasing force of the biasing member 54C.

Figure 7B:
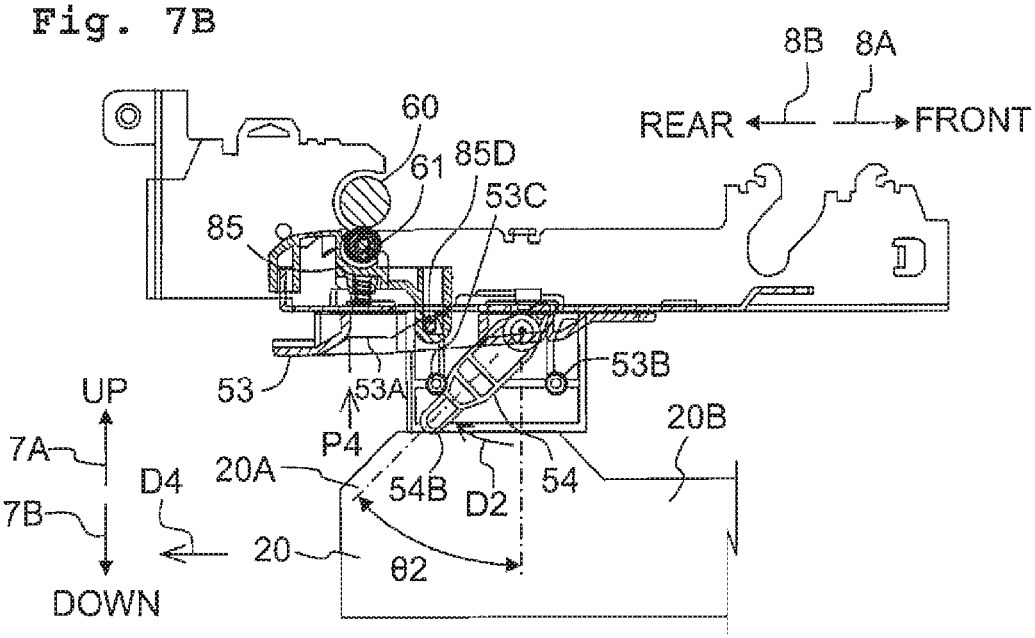

As depicted in FIG. 7A, the feed tray 20 pulled out of the printer unit 11 (in the pull-out state) is in the pull-out position P2. When the feed tray 20 in the state depicted in FIG. 7A is installed in or inserted to the printer unit 11, the feed tray 20 is moved in the rear direction 8B. In this situation, the projecting part 20A of the feed tray 20 makes contact with the front end 54B of the lever 54 in the first state. As a result, as depicted in FIG. 7B, the lever 54 in the first state pivots around the pivoting shaft 54A in a second pivoting direction D2 by an angle θ2 in the course of the insertion of the feed tray 20 into the printer unit 11, which makes the lever 54 a third state. The front end 54B of the lever 54 in the third state is positioned on the upper rear side of the front end 54B of the lever 54 in the first state. Note that the angle θ2 is greater than 0° and smaller than 180°.

<Moving Member 53>

The moving member 53 is provided in the first frame 51 to be movable along the installation direction D4 and the pull-out direction D3 (front direction 8A and rear direction 8B). As depicted in FIGS. 4 to 8, the moving member 53 includes a flat plate 50 and an extending part 50C. The flat plate 50 extends along the lower surface of the first frame 51 in the left direction 9A, right direction 9B, front direction 8A, and rear direction 8B. The extending part 50C extends from the left and right ends of the flat plate 50 in the lower direction 7B. As depicted in FIG. 5, the extending part 50C is a plate-shaped member of which shape is substantially rectangular as viewed in the left direction 9A and right direction 9B. The cross section, of the extending part 50C, perpendicular to the upper direction 7A and lower direction 7B has substantially "]" shape. The lower surface of the extending part 50C is parallel to the front direction 8A and rear direction 8B.

A recess 50B, which is formed as a rectangular opening, is formed in the lower surface of the flat plate 50 of the moving member 53. Recesses 50B are formed in the flat plate 50 along the left direction 9A and right direction 9B while corresponding to the roller holders 85. Each of the recesses 50B has cams 50A on its right and left ends. The lower surface of each cam 50A constitutes the contact surface 53A which can make contact with the roller holder 85. The contact surface 53A is substantially orthogonal to a first biasing direction (for example, the upper direction 7A) in which the biasing member 57 biases the roller holder 85. Further, the extending part 50C of the moving member 53 has a first contact part 53B and a second contact part 53C.

<Cam 50A and Contact Surface 53A>

The cam 50A is a trapezoidal-shaped member extending in the front direction 8A and rear direction 8B. As depicted in FIG. 5, the cam 50A includes, on its lower end, an inclined surface 50D of which rear end is positioned on the lower side of the front end thereof. The contact surface 53A extends from the rear end of the inclined surface 50D in the rear direction 8B. The contact surface 53A is perpendicular to the upper direction 7A and lower direction 7B. The contact surface 53A is the lowest part of the lower surface of the cam 50A.

<First Contact Part 53B and Second Contact Part 53C>

As depicted in FIG. 5, the extending part 50C of the moving member 53 has a rib 53D extending in the front direction 8A and rear direction 8D. As depicted in FIG. 4, the extending part 50C positioned on the left side includes the first contact part 53B and the second contact part 53C which have a cylindrical shape to extend from the rib 53D in the left direction 9A, and the extending part 50C positioned on the right side includes the first contact part 53B and the second contact part 53C which have a cylindrical shape to extend from the rib 53D in the right direction 9B. The first contact part 53B is positioned on the front side of the center of the extending part 50C in the front direction 8A and rear direction 8B. The second contact part 53C is positioned on the rear side of the center of the extending part 50C in the front direction 8A and rear direction 8B. The pivoting shaft MA of the lever 54 is disposed between the first contact part 53B and the second contact part 53C in the front direction 8A and rear direction 8B. Namely, the first contact part 53B is positioned in the pull-out direction D3 (front direction 8A) relative to the lever 54 and the second contact part 53C is positioned in the installation direction D4 (rear direction 8B) relative to the lever 54.

As depicted in FIG. 6A, the first contact part 53B is in contact with the front surface of the lever 54 in the first state in a state that the moving member 53 is in the first position P4. As depicted in FIG. 7A, the second contact part 53C is in contact with the rear surface of the lever 54 in the first state in a state that the moving member 53 is in the second position P3. Thus, the lever 54 is in the first state by making contact with the first contact part 53B of the moving member 53 in the first position P4. Further, the lever 54 is in the first state by making contact with the second contact part 53C of the moving member 53 in the second position P3. As depicted in FIG. 6B, when the lever 54 in the first state pivots in the first pivoting direction D1 by the angle θ1 to become the second state, the front surface of the lever 54 pushes the first contact part 53B in the front direction 8A to cause the movement of moving member 53 in the second position P3. As depicted in FIG. 7B, when the lever 54 in the first state pivots in the second pivoting direction D2 by the angle θ2 to become the third state, the rear surface of the lever 54 pushes the second contact part 53C in the rear direction 8B to cause movement of the moving member 53 in the first position P4. The angle θ1 may be identical to or different from the angle θ2.

<Interlocking Operation>

When the feed tray 20 is in the installation state as depicted in FIG. 6A, the moving member 53 is in the first position P4. In this situation, the roller holder 85 (the contact shaft 85D in particular, see FIG. 5) has no contact with the contact surface 53A and the pinch roller 61 is in the contact position P11 where the pinch roller 61 is in contact with the conveyance roller 60. Namely, in this situation, the conveyance roller pair 59 is in the nip state in which the conveyance roller pair 59 can convey the recording sheet 12 in the conveyance direction 15 while nipping it. As depicted in FIG. 6B, when the lever 54 in the first state pivots to become the second state due to movement of the feed tray 20 in the pull-out direction D3, the lever 54 pivoting to become the second state pushes the first contact part 53B in the front direction 8A. This moves the moving member 53 to the second position P3 in the front direction 8A. During this process, the contact shaft 85D of the roller holder 85 makes contact with the inclined surface 50D, and finally makes contact with the contact surface 53A by being guided by the inclined surface 50D along with the movement of the moving member 53. This moves the pinch roller 61 downward to the separation position P12 against the biasing force of the biasing member 57, so that the pinch roller 61 is separate from the conveyance roller 60. Accordingly, the nip state of the conveyance roller pair 59 is released and the conveyance roller pair 59 is in the nip released state.

When the feed tray 20 is in the pull-out state as depicted in FIG. 7A, the moving member 53 is in the second position P3. In this situation, the roller holder 85 (the contact shaft 85D in particular, see FIG. 5) is in contact with the contact surface 53A and the pinch roller 61 is in the separation position P12 where the pinch roller 61 is separate from the conveyance roller 60. Namely, in this situation, the conveyance roller pair 59 is in the nip released state. As depicted in FIG. 7B, when the lever 54 in the first state pivots to become the third state due to movement of the feed tray 20 in the installation direction D4, the lever 54 pivoting to become the third state pushes the second contact part 53C in the rear direction 8B. This moves the moving member 53 to the first position P4 in the rear direction 8B. As a result, the contact between the roller holder 85 and the contact surface 53A is lost and the pinch roller 61 is moved upward to the contact position P11 by the biasing force of the biasing member 57 so that the pinch roller 61 makes contact with the conveyance roller 60. Accordingly, the conveyance roller pair 59 has the nip state in which the conveyance roller pair 59 can convey the recording sheet 12 while nipping it.

As described above, the projecting part 20A, which can make contact with the lever 54 in the first state in the course of the insertion and pull-out of the feed tray 20, is provided for the feed tray 20. When the feed tray 20 moves from the installation position P1 to the pull-out position P2, the lever 54 pivots from the first state to the second state. When the feed tray 20 moves from the pull-out position P2 to the installation position P1, the lever 54 pivots from the first state to the third state.

The moving member 53 moves to the second position P3 due to pivoting of the lever 54 from the first state to the second state. The moving member 53 moves to the first position P4 due to pivoting of the lever 54 from the first state to the third state. Accordingly, the moving member 53 moves between the second position P3 and the first position P4 while being linked with the change in the state of the lever 54.

More specifically, the first contact part 53B of the moving member 53 makes contact with the lever 54 pivoting from the first state to the second state, thereby moving the moving member 53 to the second position P3. Further, the second contact part 53C of the moving member 53 makes contact with the lever 54 pivoting from the first state to the third state, thereby moving the moving member 53 to the first position P4.

Effects of Embodiment

According to this embodiment, the lever 54 is biased by the biasing member 57 to have the first state as the specified state. The feed tray 20 makes contact with the lever 54 in the first state both of when the feed tray 20 is moved from the installation position P1 to the pull-out position P2 and when the feed tray 20 is moved from the pull-out position P2 to the installation position P1. The lever 54 in the first state freely pivots in the first pivoting direction D1 and the second pivoting direction D2 irrespective of the state of the conveyance roller pair 59, namely, the state of the conveyance roller pair 59 may be the nip state or the nip released state.

For example, when the conveyance roller pair 59 has returned to the nip state due to, for example, an erroneous operation by the user in a state that the feed tray 20 is pulled out of the printer unit 11, the feed tray 20 is in the pull-out position P2 (see FIG. 7A) as indicated by the two-dot chain line in FIG. 6A. Under this situation, when the feed tray 20 is installed in or inserted into the printer unit 11, the projecting part 20A makes contact with the lever 54 in the first state. Here, the lever 54 can freely pivot from the first state to the second state. Thus, in this case also, the feed tray 20 does not hit the lever 54, namely, the feed tray 20 can be installed in the printer unit 11 without obstruction.

Second Embodiment

Subsequently, the second embodiment of the present teaching will be explained. The front direction 8A and rear direction 8B are referred to collectively as the front-rear direction 8 and the left direction 9A and right direction 9B are referred to collectively as the left-right direction 9 in some cases.

<Feed Tray 120>

Figure 9:
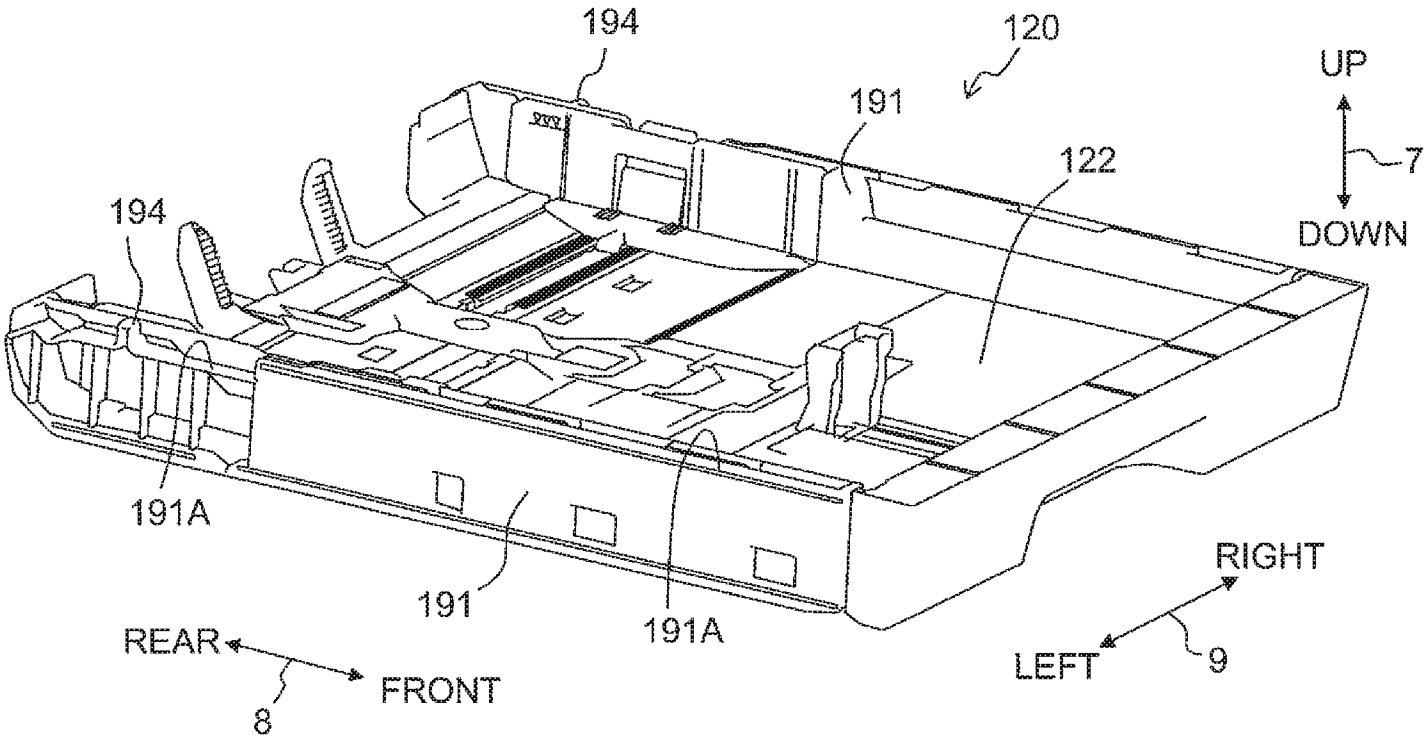
FIG. 9 is a perspective view of a feed tray 120.

As depicted in FIG. 9, a feed tray 120 is a box-shaped member which is open at the upper side thereof. The feed tray 120 includes a bottom plate 122 on which recording sheets 12 (see FIG. 2) are placed or supported in a stacked state and side plates 191 provided to stand upward at the left and right ends of the bottom plate 122.

A contact part 194 (an exemplary protrusion) is provided in an upper surface 191A of each of the side plates 191. The contact part 194 projects upward from the upper surface 191A to make contact with a lever 154 which will be described later. The contact part 194 has a substantially rectangular shape in side view.

<Support Frame 151 and Side Frame 155>

Figure 10:
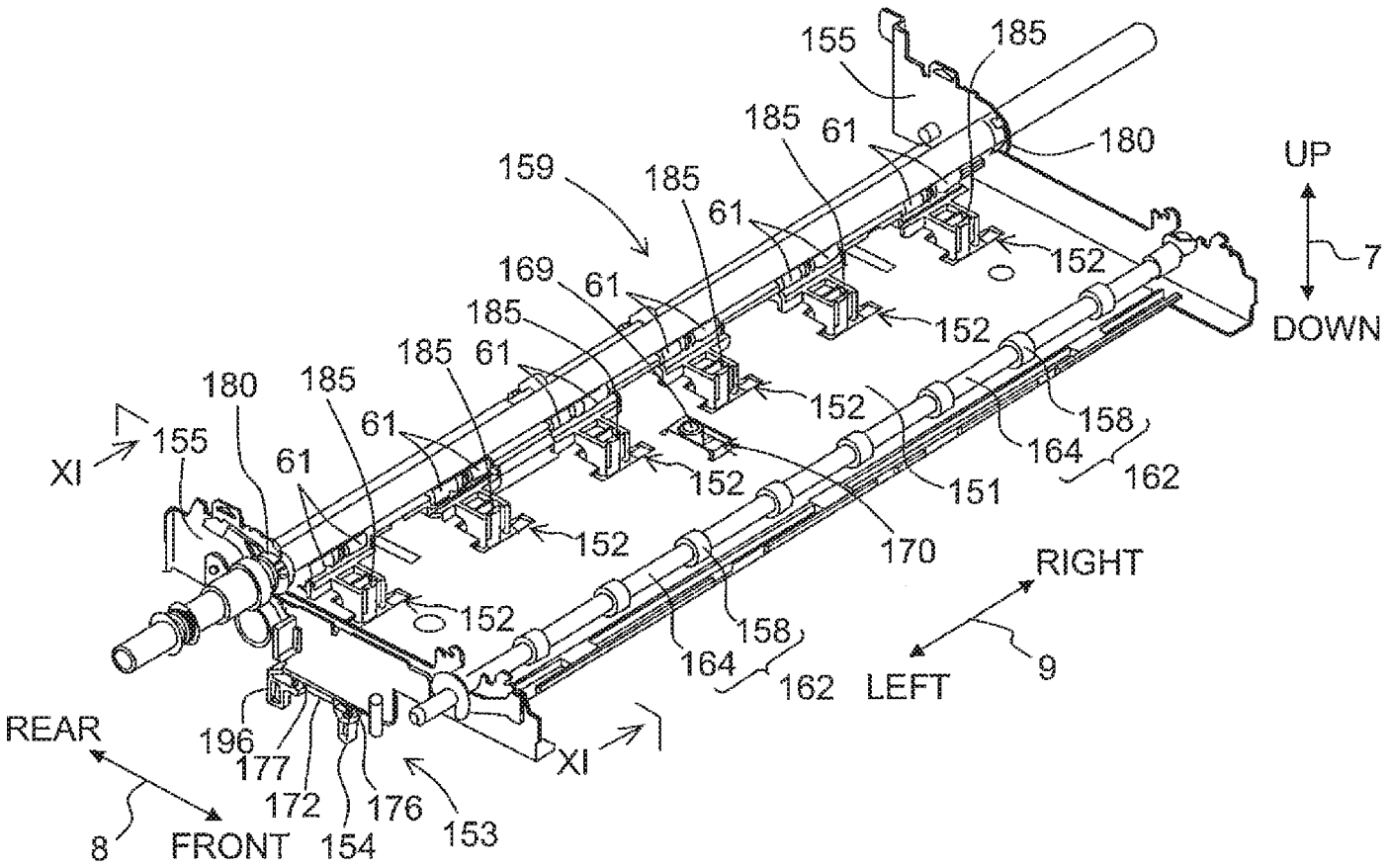
FIG. 10 is a perspective view of a moving member 153, a support frame 151, side frames 155, a conveyance roller pair 59, a discharge roller 62, and roller holders 185 as viewed from above.

A support frame 151 depicted in FIG. 10 is disposed below the platen 42. The support frame 151 made of metal is a plate-like member extending in the front-rear direction 8 and left-right direction 9. Illustration of the platen 42 is omitted in FIG. 10.

The support frame 151 has openings 152 formed at intervals in the left-right direction 9. The openings 152 are formed at positions corresponding to roller holders 185 which will be described later. An elongated hole 170 elongated in the front-rear direction 8 is formed in the center of the support frame 151 in the left-right direction 9.

Side frames 155, which project upward and extend in the front-rear direction 8, are provided at the right and left ends of the support frame 151. The side frames 155 are positioned on the right and left sides of a linear portion 134, respectively. The side frames 155 are made of metal. In the second embodiment, the side frames 155 are formed integrally with the support frame 151.

<Roller Holder 185 and Coil Spring 186>

Pinch rollers 61 are rotatably supported by the roller holders 185 depicted in FIGS. 10 and 11. As will be described later, the roller holders 185 are supported by the support frame 151.

As depicted in FIG. 10, the roller holders 185 are provided corresponding to the pinch rollers 61 respectively. The roller holders 185 are provided at intervals in the left-right direction 9. The roller holders 185 may not correspond to the pinch rollers 61 respectively. For example, three roller holders 185 may be provided for six pinch rollers 61 such that each of the roller holders 185 supports two pinch rollers 61.

Figure 11A:
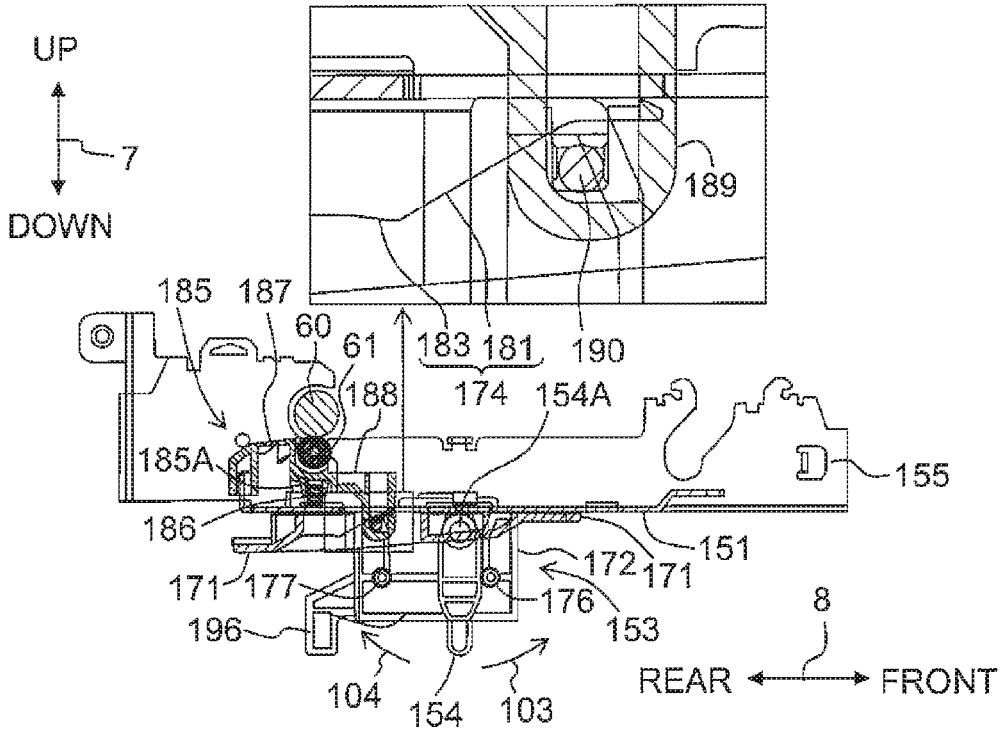

As depicted in FIG. 11A, the roller holder 185 rotatably supports the pinch roller 61 approximately in the center in the front-rear direction 8. The roller holder 185 includes a rearward extending part 187, a frontward extending part 188, a downward extending part 189, and a contact part 190, the rearward extending part 187 extending rearward from the approximately center part, the frontward extending part 188 extending frontward from the approximately center part, the downward extending part 189 extending downward from the front end of the frontward extending part 188, the contact part 190 projecting from the lower end of the downward extending part 189 in the left-right direction 9 and capable of making contact with a moving member 153 which will be described later.

One end of the coil spring 186 is connected to a lower surface 185A, of the roller holder 185, which is arranged in the center of the roller holder 185. The other end of the coil spring 186 is connected to the upper surface of the support frame 151. Accordingly, the roller holder 185 is supported by the support frame 151 via the coil spring 186.

The downward extending part 189 penetrates the opening 152 (see FIG. 10) formed in the support frame 151 and an opening 173 (see FIG. 12) formed in the moving member 153.

Figure 11B:
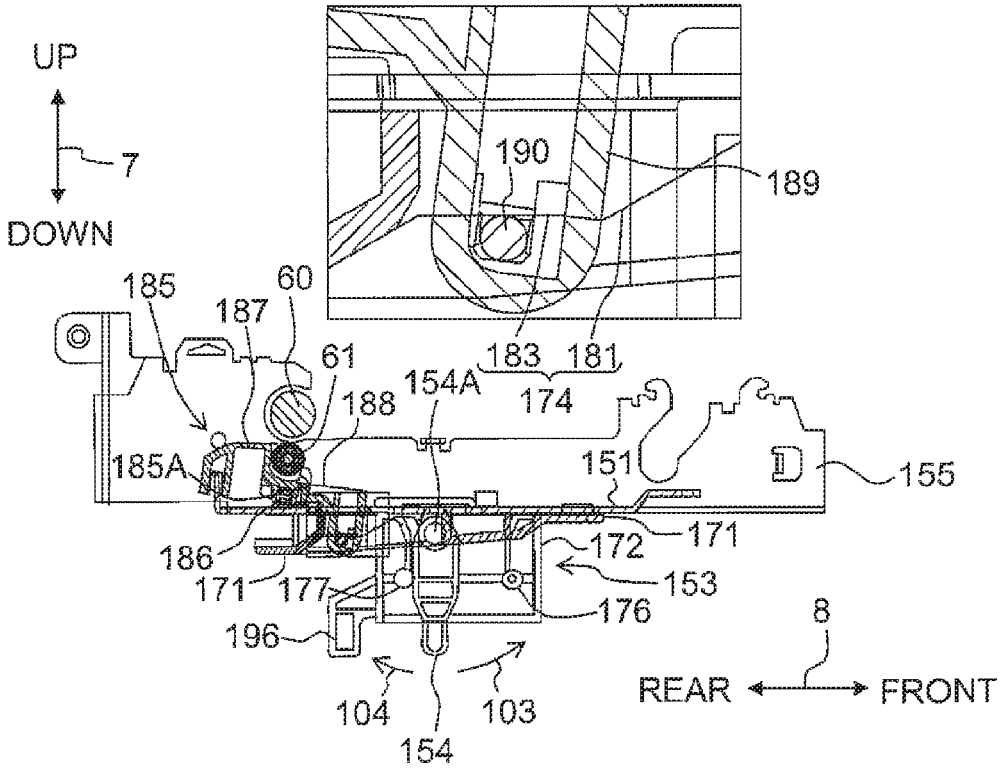

The expansion and contraction of the coil spring 186 enables the roller holder 185 to move between a contact position depicted in FIG. 11A and a separation position depicted in FIG. 11B approximately along an up-down direction 7.

When the roller holder 185 is in the contact position, the pinch roller 61 is in contact with the conveyance roller 60 by being pushed against the conveyance roller 60 by the coil spring 186. Namely, the coil spring 186 biases the roller holder 185 toward the contact position.

The roller holder 185 in the separation position is positioned on the side lower than the roller holder 185 in the contact position. When the roller holder 185 is in the separation position, the pinch roller 61 is separate from the conveyance roller 60. The coil spring 186 under this situation contracts further than the situation in which the roller holder 185 is in the contact position.

<Moving Member 53>

As depicted in FIGS. 11A and 11B, the moving member 153 is provided on the lower side of the support frame 151. The moving member 153 is movably supported by an unillustrated frame in the front-rear direction 8. The moving member 153 is supported by the unillustrated frame in a state of making contact with the lower surface of the support frame 151 from the lower side. The moving member 153 moves in a state of making contact with the lower surface of the support frame 151.

As depicted in FIG. 10, a projection 169 projecting upward is formed in the center of the upper surface of the moving member 153 in the left-right direction 9. The projection 169 is inserted into the elongated hole 170 formed in the support frame 151. The length of the projection 169 in the left-right direction 9 is substantially the same as the length of the elongate hole 170 in a width direction (left-right direction 9). Further, the length of the elongated hole 170 in a longitudinal direction (front-rear direction 8) is longer than the length of the projection 169 in the front-rear direction 8. Thus, the projection 169, that is, the moving member 153 is movable along the elongated hole 170 in the front-rear direction 8 in a state of being positioned in the left-right direction 9.

Figure 12:
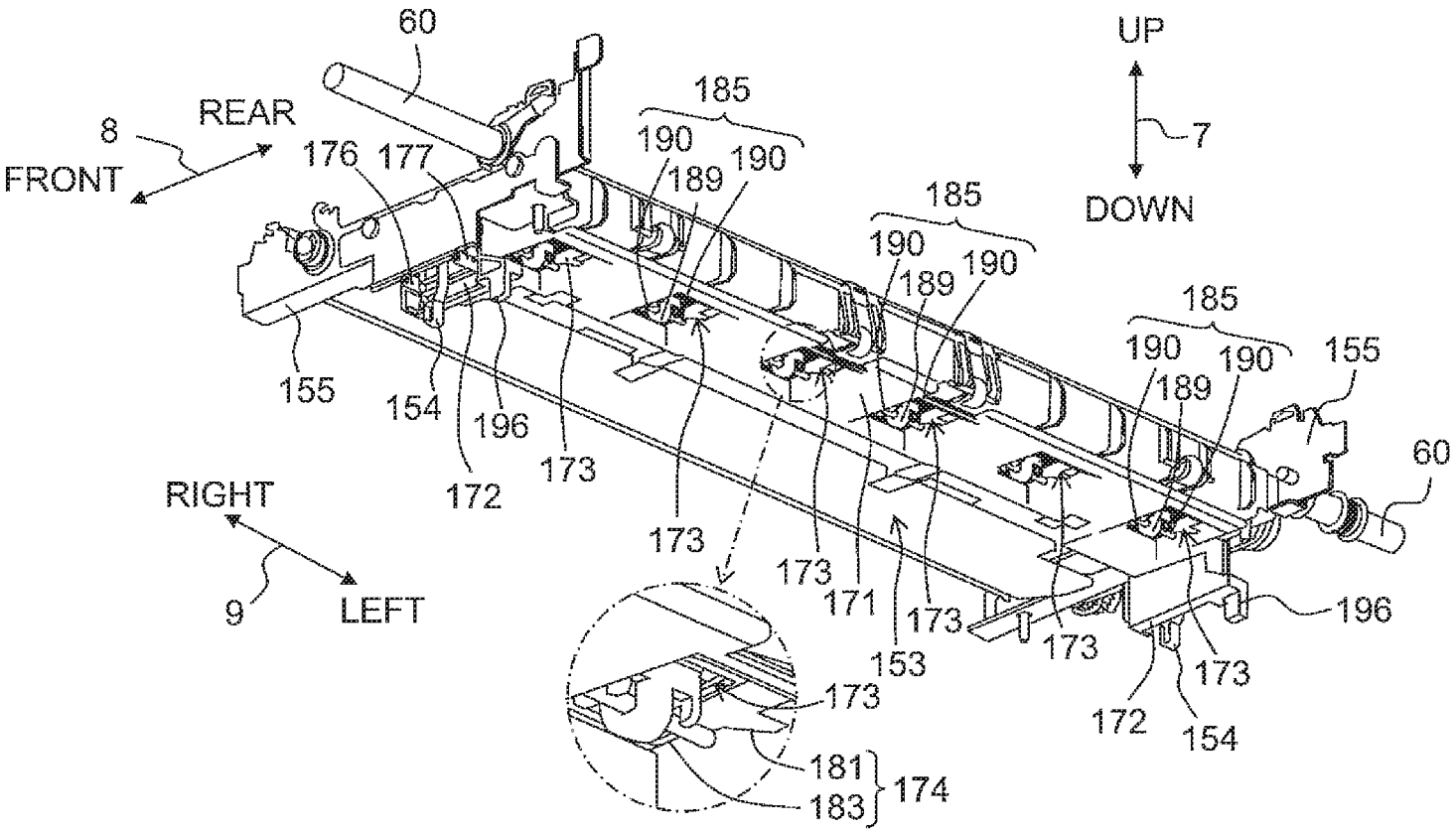
FIG. 12 is a perspective view of the moving member 153, the side frames 155, the conveyance roller 60, and the roller holders 185 as viewed from below.

As depicted in FIGS. 11A, 11B and FIG. 12, the moving member 153 includes a main body 171 and side walls 172, the main body 171 being a part in which lengths in the left-right direction 9 and the front-rear direction 8 are longer than the length in the up-down direction 7, the side walls 172 projecting downward at the right and left ends of the main body 171.

The main body 171 has openings 173 at intervals in the left-right direction 9. The openings 173 are formed at positions corresponding to the openings 152 (see FIG. 10) formed in the support frame 151. The openings 152 and 173 overlap with each other in planar view such that the openings 152 are positioned on the upper side of the openings 173. The downward extending parts 189 of the roller holders 185 penetrate the openings 173 through the openings 152. The length of the opening 173 in the front-rear direction 8 is longer than that of the opening 152 in the front-rear direction 8. Thus, the opening 152 and the opening 173 overlap with each other in planer view, irrespective of the position of the moving member 153 movable in the front-rear direction 8. As a result, the downward extending parts 189 of the roller holders 185 penetrate the openings 152, 173 irrespective of the position of moving member 153.

Cams 174 are formed in the lower surface of the moving member 153. The cams 174 are formed adjacently to the openings 173 on its right and left sides. In other words, each of the openings 173 is sandwiched by two cams 174 in the left-right direction 9. Namely, two cams 174 are provided for each of the roller holders 185. Note that the number of cams 174 provided for each of the roller holders 185 is not limited to two. For example, a single cam 174 may be provided for each of the roller holders 185.

Each of the cams 174 is a surface facing downward and extending in the front-rear direction 8. The contact part 190, which projects rightward from the downward extending part 189 of the roller holder 185 penetrating the opening 173, makes contact with, from below, the cam 174 formed on the right side of the opening 173. The contact part 190, which projects leftward from the downward extending part 189 of the roller holder 185 penetrating the opening 173, makes contact with, from below, the cam 174 formed on the left side of the opening 173.

Each of the cams 174 has an inclined surface 181 and a horizontal surface 183. The inclined surface 181 is inclined upward from the rear side to the front side. In other words, the inclined surface 181 is inclined to approach the pinch roller 61 from the rear side to the front side. The horizontal surface 183 is formed continuously to the rear end of the inclined surface 181. The horizontal surface 183 extends substantially in the front-rear direction 8.

Two projections 176, 177 are formed in the side walls 172, respectively. The projection 176 is an exemplary second projection. The projection 177 is an exemplary first projection. The projections 176, 177 project rightward from a right side wall of the side walls 172, and the projections 176, 177 project leftward from a left side wall of the side walls 172. The projections 176, 177 are formed at intervals in the front-rear direction 8. The projection 176 is formed on the front side of the projection 177.

Making the projections 176, 177 contact with the levers 154 moves the moving member 153 between a first position depicted in FIG. 11A and a second position depicted in FIG. 11B along the front-rear direction 8 (a direction perpendicular to the up-down direction 7 as the moving direction of the roller holders 185). The first position is on the rear side of the second position. The moving direction of the moving member 153 is not limited to the front-rear direction 8, and may be any direction provided that the moving direction of the moving member 153 intersects with the moving direction of the roller holders 185.

As depicted in FIG. 11A, when the moving member 153 is in the first position, the cam 174 is positioned on the rear side of the contact part 190 of the roller holder 185 and is separate from the roller holder 185. In this situation, the roller holder 185 moves upward by the biasing force of the coil spring 186. Thus, the roller holder 185 is in the contact position and the pinch roller 61 is in contact with the conveyance roller 60. The moving member 153 in the first position may make contact with the roller holder 185, provided that the roller holder 185 is in the contact position with the moving member 153 being in the first position.

The contact part 190 is guided by the inclined surface 181 while making contact therewith during movement of the moving member 153 from the first position to the second position. This moves the roller holder 185 downward against the biasing force of the coil spring 186. As depicted in FIG. 11B, when the moving member 153 is in the second position, the horizontal surface 183 of the cam 174 is in contact with the contact part 190 from above. In this situation, the roller holder 185 is in the separation position, which is on the lower side of the contact position, against the biasing force of the coil spring 186 and the pinch roller 61 is separate from the conveyance roller 60.

As depicted in FIGS. 10 and 12, a contact part 196 projects downward from each of the side walls 172. The contact part 196 is provided on the rear side of the projection 177 in the front-rear direction 8. Lower ends of the contact parts 196 can make contact with the contact parts 194 of the feed tray 120. As will be described later, the contact parts 194 make contact with the contact parts 196 from the front side, thereby pushing the contact parts 196 rearward. Accordingly, the moving member 153 moves rearward.

<Levers 154>

As depicted in FIGS. 10 to 12, levers 154 are provided on the right and left sides of the side walls 172 of the moving member 153. Each of the levers 154 is disposed between the projections 176, 177 in the front-rear direction 8. The lever 154 is disposed on the same position as the contact part 196 in the left-right direction 9. The lever 154 extends in the up-down direction 7. The upper end of the lever 154 is positioned on the upper side of the projections 176, 177. The lower end of the lever 154 is positioned on the lower side of the projections 176, 177. The lower end of the lever 154 has substantially the same height as the lower end of the contact part 196.

As depicted in FIGS. 11A and 11B, the upper end of the lever 154 is supported by an unillustrated frame to be pivotable around a pivoting shaft 154A extending in the left-right direction 9. This configuration allows the lever 154 to pivot in directions indicated by arrows 103, 104, with the upper end of the lever 154 as a pivoting center.

Figure 15:
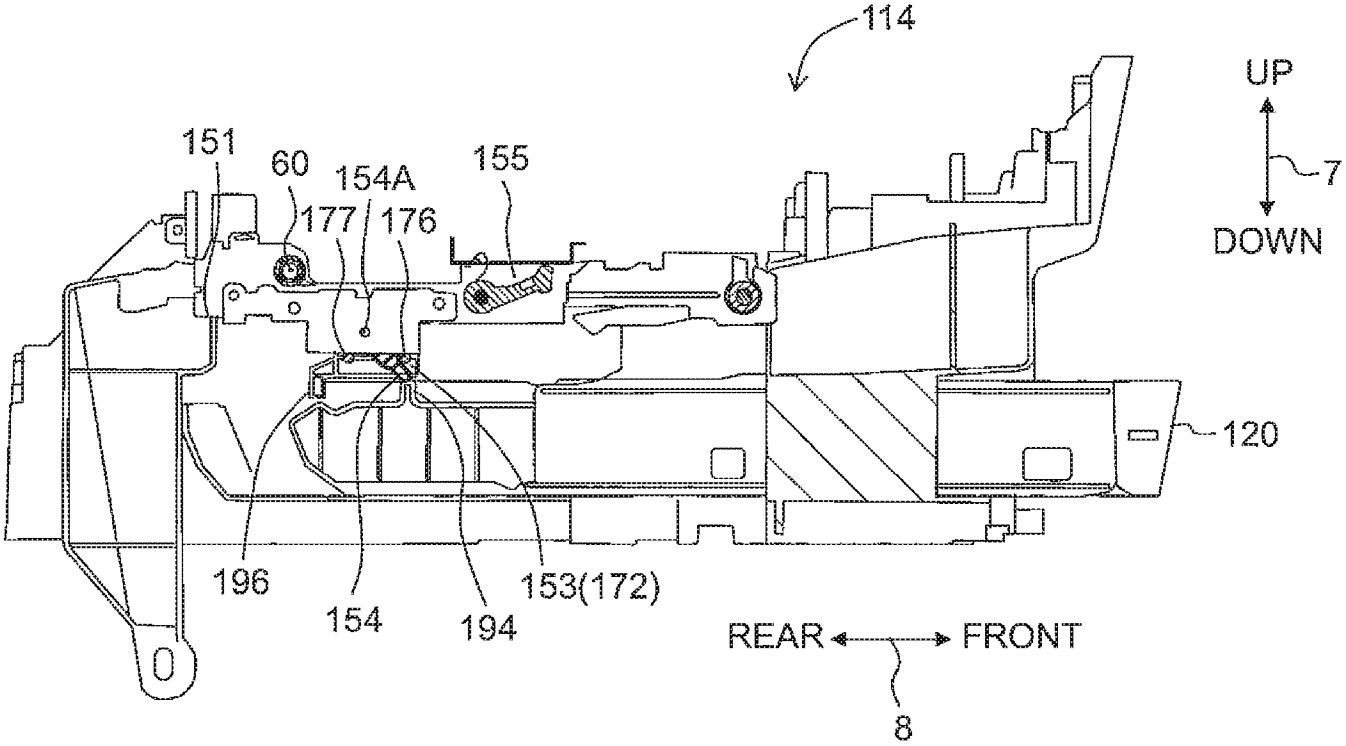
FIG. 15 is a vertical cross-sectional view depicting an internal structure of the printer unit 11 in which the lever 154 in a second state runs on the contact part 194.
Figure 16:
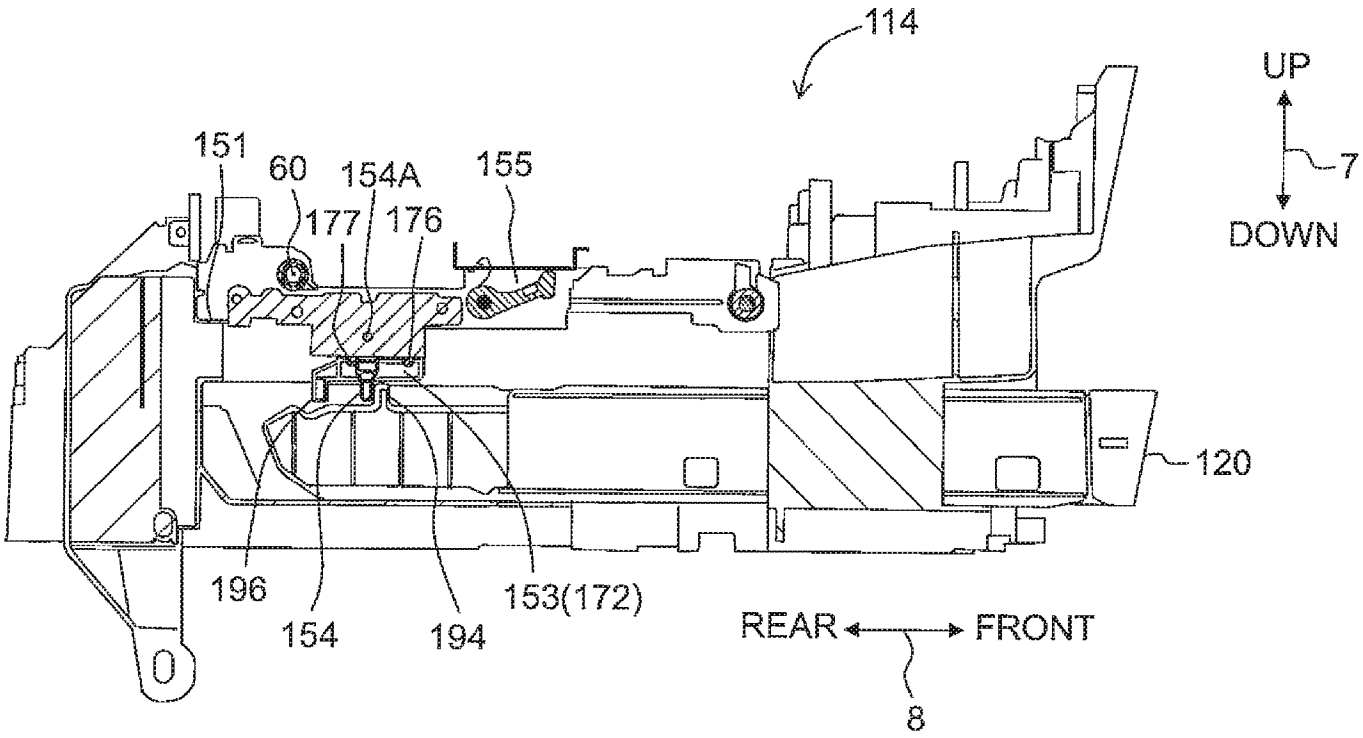
FIG. 16 is a vertical cross-sectional view depicting an internal structure of the printer unit 11 in which the contact part 194 is in contact with the lever 154 from a front side.
Figure 17:
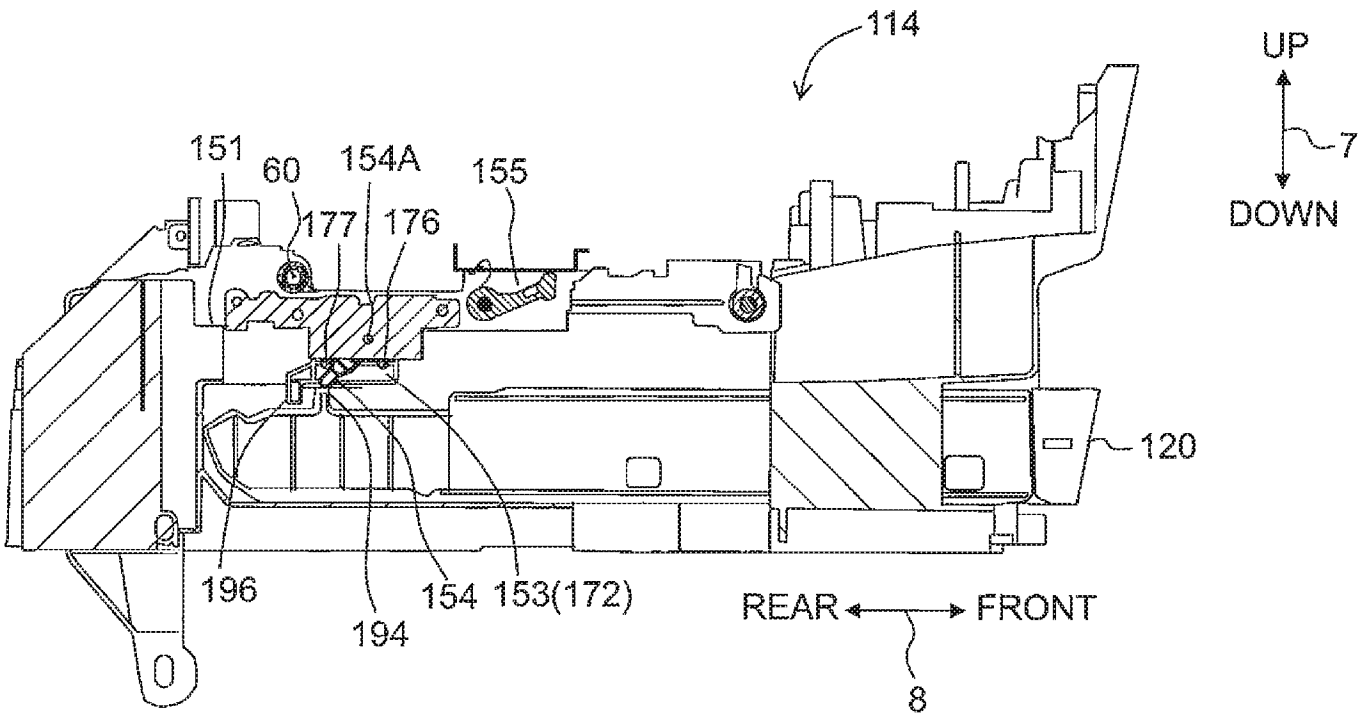
FIG. 17 is a vertical cross-sectional view depicting an internal structure of the printer unit 11 in which the lever 154 in a first state runs on the contact part 194.

Specifically, pivoting of the lever 154 causes the state change in the lever 154 between a first state depicted in FIG. 17, a second state depicted in FIG. 15, and a third state depicted in FIG. 16. The third state is a state in which the lever 154 extends approximately in the up-down direction 7. The first state is a state in which the lever 154 in the third state has pivoted around the pivoting shaft 154A in the direction (see FIGS. 11A and 11B, an exemplary first pivoting direction) indicated by the arrow 104 by an angle of less than 180°. The second state is a state in which the lever 154 in the third state has pivoted around the pivoting shaft 154A in the direction (see FIGS. 11A and 11B, an exemplary second pivoting direction) indicated by the arrow 103 by an angle of less than 180°.

The lever 154 pushes the projection 176 by making contact with the projection 176 from the rear side during the state change from the third state to the second state. This moves the moving member 153 frontward. That is, the projection 176 is disposed in the direction indicated by the arrow 103 relative to the lever 154 in the third state, and the projection 176 penetrates in a pivoting area of the lever 154. The lever 154 pushes the projection 177 by making contact with the projection 177 from the front side during the state change from the third state to the first state. This moves the moving member 153 rearward. Namely, the projection 177 is disposed in the direction indicated by the arrow 104 relative to the lever 154 in the third state, and the projection 177 penetrates in the pivoting area of the lever 154.

An unillustrated torsion spring (an exemplary biasing member) is attached to the upper end of the lever 154. The torsion spring biases the lever 154 toward the third state. Namely, in the second embodiment, when no external force is applied to the lever 154, the lever 154 is maintained in the third state by the biasing force of the torsion spring. When the lever 154 changes the state from the third state to the first or second state, the lever 154 is required to pivot against the biasing force of the torsion spring.

The lower end of the lever 154 can contact with the contact part 194 of the feed tray 120. As will be described later, the state change in the lever 154 is caused by making the lever 154 contact with the contact part 194 and pushing the lever 154 with the contact part 194.

<Movement of Moving Member 153, Lever 154, and Roller Holder 185>

An explanation will be made below about movement of the moving member 153, the lever 154, and the roller holder 185. When the feed tray 120 is installed in a casing 14, that is, when the feed tray 120 is in the installation position, the moving member 153 is in the first position as depicted in FIG. 11A.

When the feed tray 120 is in the installation position, the lever 154 is in the third state. The lever 154 in the third state is in contact with the projection 176 of the moving member 153 in the first position from the rear side.

When the feed tray 120 is in the installation position, the contact part 194 (see FIG. 13) of the feed tray 120 is positioned on the rear side of the lever 154. Namely, the lever 154 has no contact with the feed tray 120 in the installation position. Further, the contact part 194 is positioned on the front side of the contact part 196 of the moving member 153. Namely, the contact part 194 is positioned between the contact part 196 and the lever 154 in the front-rear direction 8.

When the feed tray 120 is in the installation position, the cam 174 of the moving member 153 in the first position is positioned on the rear side of the contact part 190 of the roller holder 185 and is separate from the contact part 190 of the roller holder 185.

When the feed tray 120 is in the installation position, the roller holder 185 is in the contact position by the biasing force of the coil sprint 186. In this situation, the pinch roller 61 is in contact with the conveyance roller 60.

When the feed tray 120 is in the installation position, the lever 154 may have no contact with the projection 176; the contact part 194 may be in contact with the feed tray 120 in the installation position; and the cam 174 may be in contact with the contact part 190.

Figure 14:
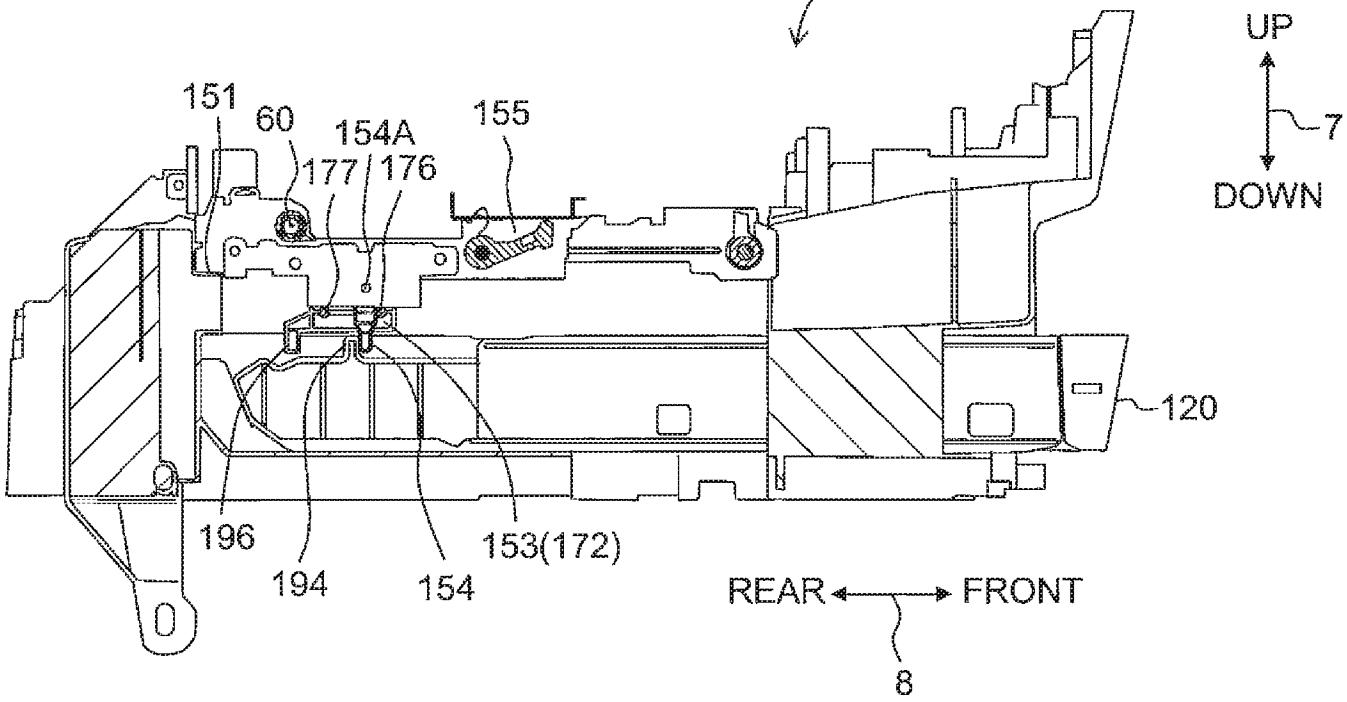
FIG. 14 is a vertical cross-sectional view depicting an internal structure of the printer unit 11 in which a contact part 194 is in contact with a lever 154 from a rear side.

When the feed tray 120 moves frontward to be pulled out of the casing 14 in the state depicted in FIG. 11A, that is, when the feed tray 120 moves from the installation position to the pull-out position, the contact part 194 of the feed tray 120 makes contact with the lever 154 from the rear side, as depicted in FIG. 14. When the feed tray 120 moves further frontward from the state depicted in FIG. 14, the lever 154 runs on the contact part 194 while being pushed by the contact part 194. This allows the lever 154 to pivot around the pivoting shaft 154A against the biasing force of the torsion spring, thereby changing the state in the lever 154 from the third state to the second state, as depicted in FIG. 15.

The lever 154 makes contact with and pushes the projection 176 during the state change in the lever 154 from the third state to the second state. This moves the moving member 153 frontward from the first position to the second position. Then, the inclined surface 181 of the cam 174 makes contact with the contact part 190 from the rear side and upper side. This guides the contact part 190 downward along the inclined surface 181 toward the horizontal surface 183. As a result, the roller holder 185 moves downward against the biasing force of the coil spring 186. That is, the roller holder 185 moves from the contact position to the separation position.

When the feed tray 120 moves further frontward from the state depicted in FIG. 15, that is, when the contact part 194 is positioned on the front side of the lower end of the lever 154, the lever 154 pivots from the second state to the third state by the biasing force of the torsion spring, as depicted in FIG. 11B. In this situation, the lever 154 is in contact with the projection 177 of the moving member 153 in the second position from the front side. The lever 154 may have no contact with the projection 177.

In the state depicted in FIG. 11B, the lever 154 has the third state; the moving member 153 is in the second position; the roller holder 185 is in the separation position; and the pinch roller 61 is separate from the conveyance roller 60. The feed tray 120 is pulled out of the casing 14 by being allowed to move further frontward.

When the feed tray 120 moves rearward to be installed in the casing 14 in the state depicted in FIG. 11B, that is, when the feed tray 120 moves from the pull-out position to the installation position, the contact part 194 makes contact with the lever 154 from the front side, as depicted in FIG. 16. When the feed tray 120 moves further rearward from the state depicted in FIG. 16, the lever 154 runs on the contact part 194 while being pushed by the contact part 194. This allows the lever 154 to pivot around the pivoting shaft 154A against the biasing force of the torsion spring, thereby changing the state in the lever 154 from the third state to the first state, as depicted in FIG. 17.

The lever 154 makes contact with and pushes the projection 177 during the state change lever 154 from the third state to the first state. This moves the moving member 153 rearward from the second position to the first position. Then, the contact part 190 is guided by the horizontal surface 183 of the cam 174, separate from the horizontal surface 183, makes contact with the inclined surface 181, and then is guided by the inclined surface 181. The roller holder 185 moves upward by the biasing force of the coil spring 186 while the contact part 190 is being guided along the inclined surface 181. That is, the roller holder 185 moves from the separation position to the contact position.

When the feed tray 120 moves further rearward from the state depicted in FIG. 17 to position the contact part 194 on the rear side of the lower end of the lever 154, the lever 154 pivots by the biasing force of the torsion spring to change its state from the first state to the third state, as depicted in FIG. 11A. In this situation, the lever 154 is in contact with the projection 176 of the moving member 153 in the first position from the rear side. The lever 154 may have no contact with the projection 176.

In the state depicted in FIG. 11A, the lever 154 has the third state; the moving member 153 is in the first position; the roller holder 185 is in the contact position; and the pinch roller 61 is in contact with the conveyance roller 60. The feed tray 120 is installed in the casing 14 by moving it further rearward. That is, after the movement further rearward, the feed tray 120 is in the installation position.

<Movement of Moving Member 153 by Action of Contact Part 196>

When the feed tray 120 moves frontward in the state depicted in FIG. 15, the feed tray 120 is pulled out of the casing 14 and the lever 154 becomes the third state, as described above. When the contact part 194 of the feed tray 120 makes contact with the lever 154 from the front side during installation of the feed tray 120, the lever 154 changes the state from the third state to the first state. This moves the moving member 153 from the second position to the first position and moves the roller holder 185 from the separation position to the contact position.

Meanwhile, when the feed tray 120 moves rearward in the state depicted in FIG. 15, the contact part 194 separates from the lever 154. This allows the lever 154 to pivot around the pivoting shaft 154A by the biasing force of the torsion spring, thereby changing the state in the lever 154 from the second state to the third state. That is, the contact part 194 is positioned on the rear side of the lever 154 in the third state. In this situation, the contact part 194 can not make contact with the lever 154 from the front side. This makes it impossible to move the moving member 153 by changing the state in the lever 154 from the third state to the first state.

Figure 13:
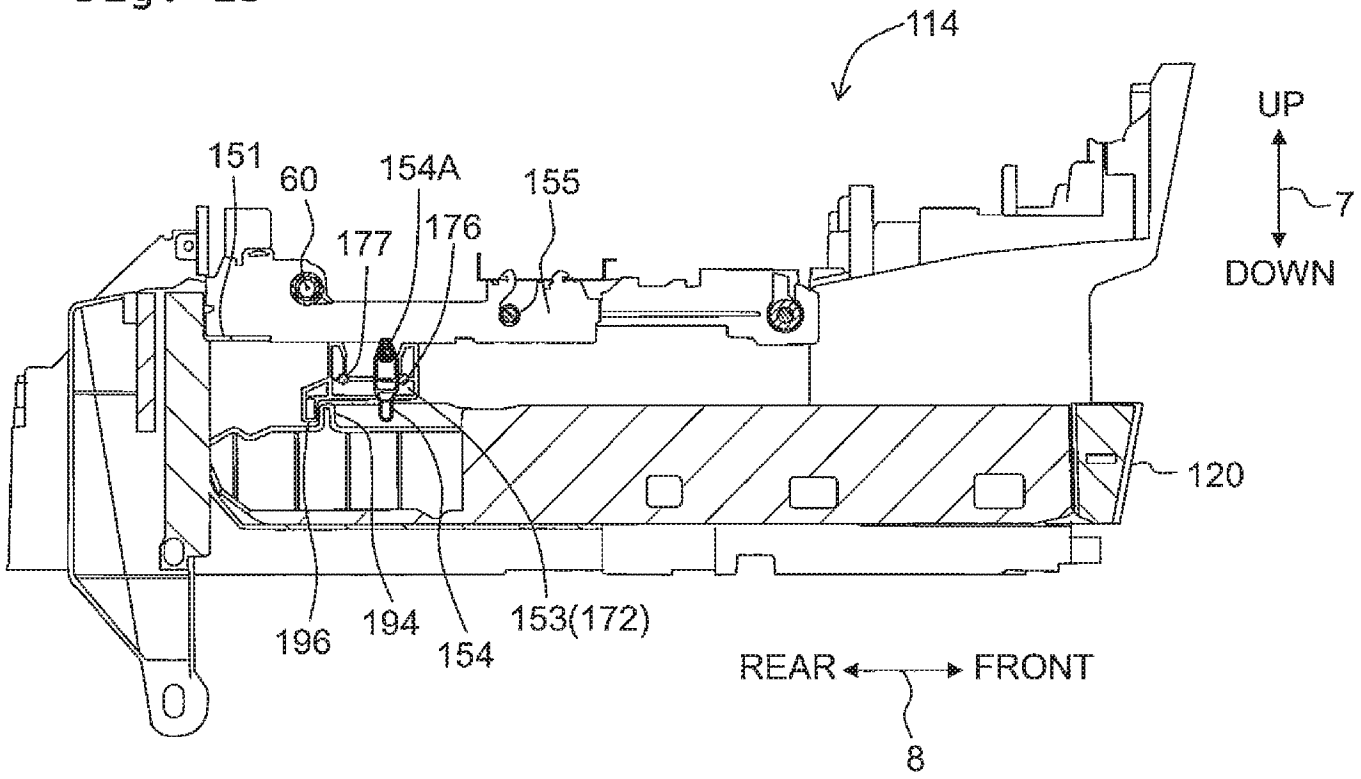
FIG. 13 is a vertical cross-sectional view depicting an internal structure of the printer unit 11 in which the feed tray 120 is in the installation position.

In such a case (the case in which the feed tray 120 moves rearward in the state depicted in FIG. 15), the contact part 194 makes contact with the contact part 196 of the moving member 153 from the front side and pushes the contact part 196 rearward, as depicted in FIG. 13. This moves the moving member 153 rearward from the second position to the first position. As a result, the roller holder 185 moves from the separation position to the contact position.

The contact part 196 is positioned on the rear side of the lever 154. Thus, the feed tray 120 under the situation that the contact part 194 is in contact with the contact part 196 from the front side is positioned closer to the installation position as compared with the feed tray 120 under the situation that the contact part 194 is in the contact with the lever 154 from the front side, that is, the former feed tray 120 is positioned on the rear side of the latter feed tray 120. That is, when the feed tray 120 in a state of being pulled out of the casing 14 is inserted into the casing 14, the contact part 194 does not make contact with the contact part 196 but makes contact with the lever 154 (see FIG. 16). When the feed tray 120 moves rearward from the state depicted in FIG. 15 (the state in which the feed tray 120 is in the course of being pulled out of the casing 14), the contact part 194 makes contact with the contact part 196 and pushes the contact part 196 rearward (see FIG. 13) without making contact with the lever 154.

When the contact part 194 makes contact with the contact part 196 from the front side to move the moving member 153 to the first position during movement of the feed tray 120 toward the installation position, the contact part 194 is in contact with the contact part 196 with the feed tray 120 being in the installation position (see FIG. 13). Namely, the contact part 196 is in contact with the feed tray 120 in the installation position. When the contact part 194 makes contact with the lever 154 from the front side to move the moving member 153 to the first position along with the state change in the lever 154 to the first state during movement of the feed tray 120 toward the installation position, the contact part 194 is positioned on the front side of the contact part 196 and has no contact with the contact part 196 with the feed tray 120 being in the installation position. Namely, the contact part 196 has no contact with the feed tray 120 in the installation position.

Effects of the Second Embodiment

In the second embodiment, the contact between the conveyance roller 60 and the pinch roller 61 is carried out as follows. Namely, the lever 154 makes contact with the feed tray 120 moving toward the installation position, and thus the state in the lever 154 is changed to the first state. The state change in the lever 154 to the first state moves the moving member 153 to the first position, thereby resulting in the contact between the conveyance roller 60 and the pinch roller 61. In this configuration, there is fear that the moving member 153 can not move to the first position depending on the movement or action of the lever 154. In the second embodiment, however, the moving member 153 can move to the first position irrespective of the movement or action of the lever 154 by making the feed tray 120 moving to the installation position contact with the contact part 196. Accordingly, the contact between the conveyance roller 60 and the pinch roller 61 can be carried out irrespective of the movement or action of the lever 154.

The feed tray 120 is typically positioned in the installation position by making contact with a member, such as a wall of the conveyance unit. When the feed tray 120 makes contact with such a member, a user holding the feed tray 120 has click feeling.

In the second embodiment, when the moving member 153 moves to the first position along with the state change in the lever 154 to the first state, the feed tray 120 moving in the installation position has no contact with the contact part 196 of the moving member 153. This prevents the user from having click feeling which would be otherwise caused by the contact between the feed tray 120 and the contact part 196. Namely, the user has click feeling only by the member such as the wall. Further, this prevents a load to the feed tray 120 which would be otherwise caused by the contact between the feed tray 120 and the contact part 196 in addition to a load caused by the contact between the feed tray 120 and the member such as the wall. Accordingly, the operational feeling of the feed tray 120 can be maintained satisfactorily during movement of the feed tray 120 to the installation position without unnecessary load to the feed tray 120.

In the second embodiment, positioning of the feed tray 120 in the installation position is performed reliably by the member such as the wall.

In the second embodiment, the lever 154 is reliably maintained in the third state in a state that the lever 154 has no contact with any other member, such as the feed tray 120, due to the biasing force of the torsion spring.

In the second embodiment, the interlocking or cooperative mechanism has a simple structure formed of projections 176, 177, thereby making it possible to manufacture the conveyance unit easily.

In the second embodiment, the projection 177 makes contact with the lever 154 in the third state with the moving member 153 being in the second position, and the projection 176 makes contact with the lever 154 in the third state with the moving member 153 being in the first position. Thus, positioning of the lever 154 in the third state is performed by projections 176 and 177 respectively, both when the moving member 153 is in the first position and when the moving member 153 is in the second position.

In the second embodiment, the lever 154 has no contact with the feed tray 120 in the installation position. Thus, positioning of the pinch roller 61 is not performed based on the feed tray 120 via the roller holder 185, the moving member 153, and the lever 154. This prevents deterioration of conveyance control of the recording sheet 12 which would be otherwise caused by the conveyance roller 60 and the pinch roller 61.

In the second embodiment, both of the contact part 196 and the lever 154 make contact with the contact part 194 projecting from the feed tray 120. The feed tray 120, however, may be configured as follows. Namely, the feed tray 120 includes two contact parts (first and second contact parts) for the upper surface 191A of each of the side plates 191 instead of the single contact part 194, and the contact part 196 makes contact with the first contact part and the lever 154 makes contact with the second contact part. In this case, the first contact part may be provided such that the first contact part at least partially overlaps with the contact part 196 in the left-right direction 9, and the second contact part may be provided such that the second contact part at least partially overlaps with the lever 154 in the left-right direction 9. The contact part 196 and the first contact part may be provided in different positions in the left-right direction 9, and the lever 154 and the second contact part may be provided in different positions in the left-right direction 9.

In the second embodiment, the contact part 196 is positioned on the rear side of the lever 154. The contact part 196, however, may be positioned on the front side of the lever 154 or may be the same position as the lever 154 in the front-rear direction 8. In this case, similar to the above case, the feed tray 120 includes the first and second contact parts. Positions of the contact part 196, the lever 154, the first contact part, and the second contact part are adjusted such that the position of the feed tray 120 in a case that the contact part 196 is in contact with the first contact part is positioned on the rear side of the position of the feed tray 120 in a case that the lever 154 is in contact with the second contact part.

Modified Embodiments

In the above embodiment, the case in which the conveyance unit is used in the ink-jet recording apparatus as the image recording apparatus has been explained. The conveyance unit of the present teaching, however, is used not only in the ink-jet recording apparatus but also in any other image recording apparatus such as a laser printer. Further, the conveyance unit of the present teaching can be used not only in the image recording apparatus but also in all of the apparatuses using and conveying a sheet.

In the above embodiment, the lever 54 is biased by the biasing member 57 to have the first state. The lever 54, however, may have the first state by its own weight.

In the above embodiment, the pinch roller 61 is an exemplary nip member. The nip member, however, is not limited to a driven roller such as the pinch roller 61. The nip member may be, for example, a plate-shaped or rectangular parallelepiped shaped pressing member with a pressing surface, which has a sufficiently small friction coefficient and presses the recording sheet 12 against the conveyance roller such as a reverse roller 45.

In the above embodiment, a driving roller, such as the conveyance roller 60, which is driven by a motor is an exemplary conveyance roller. The present teaching, however, is not limited to this. For example, in a configuration in which the conveyance roller 60 is disposed on the lower side and the pinch roller 61 facing the conveyance roller 60 is disposed on the upper side, the driven roller such as the pinch roller 61 may be the conveyance roller and the driving roller such as the conveyance roller 60 may be the nip member. In this configuration, pivoting of the lever 54 may move the conveyance roller 60 between a contact position in which the conveyance roller 60 makes contact with the pinch roller 61 and a separation position in which the conveyance roller 60 is separate from the pinch roller 61.

What is claimed is:

1. A conveyance unit configured to convey a sheet, comprising:

a conveyance roller;

a nip member configured to nip the sheet between the nip member and the conveyance roller and to move between a contact position in which the nip member is in contact with the conveyance roller and a separation position in which the nip member is separate from the conveyance roller;

a tray configured to support the sheet, to be installed in and be pulled out of the conveyance unit, and to move between an installation position in which the tray is installed in the conveyance unit and a pull-out position in which the tray is pulled out of the conveyance unit;

a lever configured to pivot around a pivoting shaft extending in an intersecting direction, the intersecting direction intersecting both of an installation direction in which the tray is installed into the conveyance unit and a pull-out direction in which the tray is pulled out of the conveyance unit, wherein:

the lever is configured to have a first state, a second state, and a third state, the second state being a state in which the lever in the first state has pivoted around the pivoting shaft in a first pivoting direction, the third state being a state in which the lever in the first state has pivoted around the pivoting shaft in a second pivoting direction which is an opposite direction of the first pivoting direction, the lever in the first state is configured to make contact with the tray moving between the installation position and the pull-out position, under a condition that the tray is moved from the installation position to the pull-out position, the lever pivots from the first state to the second state by making contact with the tray and the lever pivots from the second state to the first state in a case that the contact with the tray is released, under a condition that the tray is moved from the pull-out position to the installation position, the lever pivots from the first state to the third state by making contact with the tray and the lever pivots from the third state to the first state in a case that the contact with the tray is released; and an interlocking mechanism configured to:

move the nip member to the separation position due to the pivoting of the lever from the first state to the second state, maintain the nip member at the separation position due to the pivoting of the lever from the second state to the first state, move the nip member to the contact position due to the pivoting of the lever from the first state to the third state, and maintain the nip member at the contact position due to the pivoting of the lever from the third state to the first state.

2. The conveyance unit according to claim 1, wherein the tray includes a lever contact part configured to make contact with the lever in the first state, and wherein the lever contact part does not contact the lever in a state where the tray is in the installation position.

3. The conveyance unit according to claim 1, further comprising a holding member holding the nip member and being configured to move integrally with the nip member, wherein the interlocking mechanism includes a moving member configured to contact the holding member and to move between a first position in which the nip member is in the contact position and a second position in which the nip member is in the separation position, and wherein the moving member is configured to move to the second position due to the pivoting of the lever from the first state to the second state and to move to the first position due to the pivoting of the lever from the first state to the third state.

4. The conveyance unit according to claim 1, further comprising a first biasing member by which the lever is biased in the first state.

5. The conveyance unit according to claim 3, further comprising a second biasing member by which the nip member is biased toward the conveyance roller, wherein the moving member in the first position does not contact the holding member.

6. The conveyance unit according to claim 3, wherein:

the moving member is configured to move between the first position and the second position along the installation direction and the pull-out direction, the moving member includes a first contact part and a second contact part, the first contact part is disposed downstream of the lever in the pull-out direction, the first contact part being configured to contact the lever pivoting from the first state to the second state in the first pivoting direction, and to move the moving member to the second position due to the pivoting of the lever, and the second contact part is disposed downstream of the lever in the installation direction, the second contact part being configured to contact the lever pivoting from the first state to the third state in the second pivoting direction, and to move the moving member to the first position due to the pivoting of the lever.

7. The conveyance unit according to claim 6, wherein:

the lever is configured to be placed in the first state by making contact with the first contact part in a state that the moving member is in the first position, and the lever is configured to be placed in the first state by making contact with the second contact part in a state that the moving member is in the second position.

8. The conveyance unit according to claim 3, further comprising a first frame configured to movably support the holding member and the moving member.

9. The conveyance unit according to claim 8, further comprising a second frame supported by the first frame and configured to pivotably support the lever.

10. The conveyance unit according to claim 1, wherein the nip member is a roller.

11. The conveyance unit according to claim 1, further comprising a moving member configured to move between a first position and a second position along a direction perpendicular to a moving direction of the nip member, wherein:

the moving member in the first position allows the nip member to be in the contact position and the moving member in the second position allows the nip member to be in the separation position, the moving member includes a contact part configured to contact the tray, during movement of the tray from the pull-out position to the installation position, a position of the tray when in contact with the contact part is closer to the installation position as compared with a position of the tray when in contact with the lever, and making the tray, moving in the installation direction, contact the contact part moves the moving member to the first position.

12. The conveyance unit according to claim 11, wherein the contact part of the moving member, when moving to the first position along with the pivoting of the lever to the third state, does not contact the tray in the installation position.

13. The conveyance unit according to claim 11, wherein:

the interlocking mechanism includes a first projection and a second projection, the first projection being disposed in the second pivoting direction relative to the lever in the first state and penetrating a pivoting area of the lever, the second projection being disposed in the first pivoting direction relative to the lever in the first state and penetrating the pivoting area of the lever, the first projection makes contact with the lever pivoting from the first state to the third state, thereby moving the moving member to the first position, and the second projection makes contact with the lever pivoting from the first state to the second state, thereby moving the moving member to the second position.

14. The conveyance unit according to claim 13, wherein the first projection and the second projection are provided for the moving member.

15. The conveyance unit according to claim 13, wherein, in a state where the moving member is in the second position, the first projection contacts the lever in the first state, and wherein, in a state where the moving member is in the first position, the second projection contacts the lever in the first state.

16. The conveyance unit according to claim 11, wherein a position of the contact part is closer to the installation position of the tray as compared with a position of the lever, and wherein the tray includes a protrusion which is positioned between the contact part and the lever in a state where the tray is in the installation position, the protrusion being configured to make contact with the contact part and the lever during the movement of the tray.

17. An image recording apparatus comprising:
the conveyance unit as defined in claim 1; and
a recording unit configured to record an image on a sheet.

* * * * *